US006662875B2

(12) United States Patent
Bass et al.

(10) Patent No.: US 6,662,875 B2
(45) **Date of Patent: *Dec. 16, 2003**

(54) INDUCTION CHOKE FOR POWER DISTRIBUTION IN PIPING STRUCTURE

(75) Inventors: Ronald Marshall Bass, Houston, TX (US); Harold J. Vinegar, Houston, TX (US); Robert Rex Burnett, Katy, TX (US); William Mountjoy Savage, Houston, TX (US); Frederick Gordon Carl, Jr., Houston, TX (US); John Michele Hirsch, Houston, TX (US); George Leo Stegemeier, Houston, TX (US)

(73) Assignee: Shell Oil Company, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/769,048

(22) Filed: Jan. 24, 2001

(65) Prior Publication Data

US 2002/0121366 A1 Sep. 5, 2002

Related U.S. Application Data

(60) Provisional application No. 60/177,999, filed on Jan. 24, 2000, provisional application No. 60/186,376, filed on Mar. 2, 2000, provisional application No. 60/178,000, filed on Jan. 24, 2000, provisional application No. 60/186,380, filed on Mar. 2, 2000, provisional application No. 60/186,505, filed on Mar. 2, 2000, provisional application No. 60/178,001, filed on Jan. 24, 2000, provisional application No. 60/177,883, filed on Jan. 24, 2000, provisional application No. 60/177,998, filed on Jan. 24, 2000, provisional application No. 60/177,997, filed on Jan. 24, 2000, provisional application No. 60/181,322, filed on Feb. 9, 2000, provisional application No. 60/186,504, filed on Mar. 2, 2000, provisional application No. 60/186,379, filed on Mar. 2, 2000, provisional application No. 60/186,394, filed on Mar. 2, 2000, provisional application No. 60/186,382, filed on Mar. 2, 2000, provisional application No. 60/186,503, filed on Mar. 2, 2000, provisional application No. 60/186,527, filed on Mar. 2, 2000, provisional application No. 60/186,393, filed on Mar. 2, 2000, provisional application No. 60/186,531, filed on Mar. 2, 2000, provisional application No. 60/186,377, filed on Mar. 2, 2000, provisional application No. 60/186,381, filed on Mar. 2, 2000, and provisional application No. 60/186,378, filed on Mar. 2, 2000.

(51) Int. Cl.[7] ..... E21B 43/00; E21B 1/00

(52) U.S. Cl. ..... 166/369; 166/65.1; 166/53

(58) Field of Search ..... 166/250.15, 250.03, 166/372, 53, 369, 373, 65.1, 66.6; 174/37; 340/854.3, 854.4, 854.5, 855.7

(56) References Cited

U.S. PATENT DOCUMENTS

| | | | | |
|---|---|---|---|---|
| 525,663 | A | 9/1894 | Mottinger | |
| 2,917,004 | A | 12/1959 | Davis et al. | |
| 3,083,771 | A | 4/1963 | Chapman | |
| 3,247,904 | A | 4/1966 | Wakefield, Jr. | |
| 3,427,989 | A | 2/1969 | Bostock et al. | |
| 3,566,963 | A | 3/1971 | Blackledge | 166/189 |
| 3,602,305 | A | 8/1971 | Kisling, III | 116/134 |
| 3,732,728 | A | 5/1973 | Fitzpatrick | 73/151 |
| 3,814,545 | A | 6/1974 | Waters | 417/90 |
| 3,837,618 | A | 9/1974 | Juhel | 251/129 |
| 3,980,826 | A | 9/1976 | Widmer | 178/68 |
| 4,068,717 | A | 1/1978 | Needham | 166/272 |
| 4,295,795 | A | 10/1981 | Gass et al. | 417/111 |
| 4,393,485 | A | 7/1983 | Redden | 367/25 |
| 4,468,665 | A | 8/1984 | Thawley et al. | 340/856 |
| 4,545,731 | A | 10/1985 | Canalizo et al. | 417/86 |
| 4,576,231 | A | 3/1986 | Dowling et al. | 166/248 |
| 4,578,675 | A | 3/1986 | MacLeod | 340/855 |
| 4,596,516 | A | 6/1986 | Scott et al. | 417/58 |
| 4,648,471 | A | 3/1987 | Bordon | 175/4.55 |
| 4,662,437 | A | 5/1987 | Renfro | 166/65.1 |
| 4,681,164 | A | 7/1987 | Stacks | 166/304 |
| 4,709,234 | A | 11/1987 | Forehand et al. | 340/856 |
| 4,738,313 | A | 4/1988 | McKee | 166/372 |
| 4,739,325 | A | 4/1988 | MacLeod | 340/854 |
| 4,839,644 | A | 6/1989 | Safinya et al. | 340/854 |
| 4,886,114 | A | 12/1989 | Perkins et al. | 166/65.1 |
| 4,901,069 | A | 2/1990 | Veneruso | 340/853 |
| 4,972,704 | A | 11/1990 | Wellington et al. | 73/155 |
| 4,981,173 | A | 1/1991 | Perkins et al. | 166/66.4 |
| 5,001,675 | A | 3/1991 | Woodward | 367/13 |
| 5,008,664 | A | 4/1991 | More et al. | 340/854 |
| 5,130,706 | A | 7/1992 | Van Steenwyk | 340/854.6 |

| | | | | |
|---|---|---|---|---|
| 5,134,285 | A | 7/1992 | Perry et al. | 250/269 |
| 5,160,925 | A | 11/1992 | Dailey et al. | 340/853.3 |
| 5,162,740 | A | 11/1992 | Jewell | 324/347 |
| 5,172,717 | A | 12/1992 | Boyle et al. | 137/155 |
| 5,176,164 | A | 1/1993 | Boyle | 137/155 |
| 5,230,383 | A | 7/1993 | Pringle et al. | 166/66.4 |
| 5,246,860 | A | 9/1993 | Hutchins et al. | 436/27 |
| 5,251,328 | A | 10/1993 | Shaw | 455/73 |
| 5,257,663 | A | 11/1993 | Pringle et al. | 166/66.4 |
| 5,267,469 | A | 12/1993 | Espinoza | 73/40.5 |
| 5,278,758 | A | 1/1994 | Perry et al. | 364/422 |
| 5,353,627 | A | 10/1994 | Diatschenko et al. | 73/19.03 |
| 5,358,035 | A | 10/1994 | Grudzinski | 166/53 |
| 5,367,694 | A | 11/1994 | Ueno | 395/800 |
| 5,394,141 | A | 2/1995 | Soulier | 340/854.4 |
| 5,396,232 | A | 3/1995 | Mathieu et al. | 340/854.5 |
| 5,425,425 | A | 6/1995 | Bankson et al. | 166/377 |
| 5,447,201 | A | 9/1995 | Mohn | 166/375 |
| 5,458,200 | A | 10/1995 | Lagerlef et al. | 166/372 |
| 5,467,083 | A | 11/1995 | McDonald et al. | 340/854.6 |
| 5,473,321 | A | 12/1995 | Goodman et al. | 340/854.9 |
| 5,493,288 | A | 2/1996 | Henneuse | 340/854.4 |
| 5,531,270 | A | 7/1996 | Fletcher et al. | 166/53 |
| 5,561,245 | A | 10/1996 | Georgi et al. | 73/152.02 |
| 5,574,374 | A | 11/1996 | Thompson et al. | 324/338 |
| 5,576,703 | A | 11/1996 | MacLeod et al. | 340/854.4 |
| 5,587,707 | A | 12/1996 | Dickie et al. | 340/870.09 |
| 5,592,438 | A | 1/1997 | Rorden et al. | 367/83 |
| 5,662,165 | A | 9/1997 | Tubel et al. | 166/250.01 |
| 5,723,781 | A | 3/1998 | Pruett et al. | 73/152.18 |
| 5,730,219 | A | 3/1998 | Tubel et al. | 66/250.01 |
| 5,745,047 | A | 4/1998 | Van Gisbergen et al. | 340/853.1 |
| 5,782,261 | A | 7/1998 | Becker et al. | 137/155 |
| 5,797,453 | A | 8/1998 | Hisaw | 166/117.5 |
| 5,881,807 | A | 3/1999 | Boe et al. | 166/100 |
| 5,883,516 | A | 3/1999 | Van Steenwyk et al. | 324/366 |
| 5,887,657 | A | 3/1999 | Bussear et al. | 166/336 |
| 5,896,924 | A | 4/1999 | Carmody et al. | 166/53 |
| 5,934,371 | A | 8/1999 | Bussear et al. | 166/53 |
| 5,937,945 | A | 8/1999 | Bussear et al. | 166/250.15 |
| 5,941,307 | A | 8/1999 | Tubel | 166/313 |
| 5,955,666 | A | 9/1999 | Mullins | 73/52.18 |
| 5,959,499 | A | 9/1999 | Khan et al. | 330/149 |
| 5,960,883 | A | 10/1999 | Tubel et al. | 166/313 |
| 5,963,090 | A | 10/1999 | Fukuchi | 330/149 |
| 5,971,072 | A | 10/1999 | Huber et al. | 166/297 |
| 5,975,204 | A | 11/1999 | Tubel et al. | 166/250.15 |
| 5,995,020 | A | 11/1999 | Owens et al. | 340/854.9 |
| 6,012,015 | A | 1/2000 | Tubel | 702/6 |
| 6,012,016 | A | 1/2000 | Bilden et al. | 702/12 |
| 6,070,608 | A | 6/2000 | Pringle | 137/155 |
| 6,123,148 | A | 9/2000 | Oneal | 166/118 |
| 6,148,915 | A | 11/2000 | Mullen et al. | 166/278 |
| 6,192,983 | B1 | 2/2001 | Neuroth et al. | 166/250.15 |
| 6,208,586 | B1 | 3/2001 | Rorden et al. | 367/35 |
| 6,334,486 | B1 | 1/2002 | Carmody et al. | 166/53 |
| 6,484,800 | B2 | 11/2002 | Carmody et al. | 166/53 |

FOREIGN PATENT DOCUMENTS

| | | | | |
|---|---|---|---|---|
| EP | 028296 | A2 | 5/1981 | E21B/47/12 |
| EP | 295178 | | 12/1988 | E21B/47/12 |
| EP | 339825 | | 11/1989 | E21B/47/12 |
| EP | 492856 | A2 | 7/1992 | H04B/1/62 |
| EP | 641916 | A2 | 3/1995 | E21B/33/124 |
| EP | 681090 | A2 | 11/1995 | E21B/47/18 |
| EP | 697500 | A2 | 2/1996 | E21B/49/00 |
| EP | 721053 | A1 | 7/1996 | E21B/47/12 |
| EP | 732053 | A1 | 9/1996 | A21C/9/04 |
| EP | 919696 | A2 | 6/1999 | E21B/47/12 |
| EP | 922835 | A3 | 6/1999 | E21B/43/14 |
| EP | 930518 | A2 | 7/1999 | G01V/3/12 |
| EP | 964134 | A2 | 12/1999 | E21B/47/12 |
| EP | 972909 | A2 | 1/2000 | E21B/44/00 |
| EP | 999341 | A2 | 5/2000 | E21B/33/124 |
| FR | 2677134 | | 12/1992 | E21B/47/12 |
| GB | 2083321 | A | 3/1982 | H04B/5/00 |
| GB | 2325949 | A | 12/1998 | E21B/43/12 |
| GB | 2327695 | A | 2/1999 | E21B/43/12 |
| GB | 2338253 | A * | 12/1999 | E21B/47/12 |
| WO | 80/00727 | | 4/1980 | E21B/47/12 |
| WO | 93/26115 | | 12/1993 | H04N/1/40 |
| WO | 96/00836 | | 1/1996 | E21B/47/12 |
| WO | 96/24747 | | 8/1996 | E21B/43/12 |
| WO | 97/16751 | | 5/1997 | G01V/3/00 |
| WO | 97/37103 | | 10/1997 | E21B/47/01 |
| WO | 98/20233 | | 5/1998 | E21B/43/40 |
| WO | 99/37044 | | 7/1999 | H04B/13/02 |
| WO | 99/57417 | | 11/1999 | E21B/41/00 |
| WO | 99/60247 | | 11/1999 | E21B/43/12 |
| WO | 00/04275 | | 1/2000 | E21B/47/01 |
| WO | 00/37770 | | 6/2000 | E21B/37/06 |
| WO | 01/20126 | A2 | 3/2001 | E21B/43/12 |
| WO | 01/55555 | A1 | 8/2001 | E21B/47/12 |

OTHER PUBLICATIONS

Brown.Connolizo and Robertson, West Texas Oil Lifting Short Course and H.W. Winkler, "Misunderstood or overlooked Gas–Lift Design and Equipment Considerations," SPE, p. 351 (1994).

Der Spek, Alex, and Aliz Thomas, "Neural–Net Identification of Flow Regime with Band Spectra of Flow–Generated Sound", SPE Reservoir Eva. & Eng.2 (6) Dec. 1999, pp. 489–498.

Sakata et al., "Performance Analysis of Long Distance Transmitting of Magnetic Signal on Cylindrical Steel Rod", IEEE Translation Journal on magnetics in Japan, vol. 8, No. 2. Feb. 1993, pp. 102–106.

Otis Engineering, Aug. 1980, "Heavy Crude Lift System", Field Development Report, OEC 5228, Otis Corp., Dallas, Texas, 1980.

* cited by examiner

*Primary Examiner*—David Bagnell
*Assistant Examiner*—Daniel P Stephenson

(57) ABSTRACT

A current impedance device for routing a time-varying electrical current in a piping structure comprising an induction choke. The induction choke is generally concentric about a portion of the piping structure such that during operation a voltage potential forms between the piping structure and an electrical return when the time-varying electrical current is transmitted through and along the piping structure, and such that during operation part of the current can be routed through a device electrically connected to the piping structure due to the voltage potential formed. The induction choke may be unpowered and may comprise a ferromagnetic material. A system for defining an electrical circuit in a piping structure using at least one unpowered ferromagnetic induction choke, comprises an electrically conductive portion of the piping structure, a source of time-varying current, at least one induction choke, a device, and an electrical return. The system can have various configurations and embodiments to define a plurality of possible electrical circuits formed using at least one induction choke to route time-varying current. An electric power transformer can also be incorporated. The system is adapted to provide power and/or communications for the device via the piping structure. One possible application of the system is in a petroleum well where a downhole device can send or receive power and/or communication signals via a piping structure of the well.

91 Claims, 13 Drawing Sheets

80
74
68
44
76
38
54
78
64
72
72
146
70
41
36
36
58
58
70
34
58
58
51
32
42
40
52
82
82
66
56
56

80
74
68
76
44
54
78
38
64
34
30
72
72
58
41
36
36
51
31
31
40
34
58
70
52
24
51
36
36
31
31
40
58
70
52
24
51
31
31
40
52
24
51
42
31
31
40
52
24
51
32
32
40
24
34
52
72
82
82
72
66
56
56

80
68
44
38
54
78
74
30
76
41
64
58
72
72
52
40
51
70
36
34
42
32
82
56
66

80
68
78
84
84
84
54
38
74
44
64
58
58
72
72
30
30
34
41
70
70
36
36
51
32
32
58
58
42
34
40
52
72
72
66
56
56

INDUCTION CHOKE FOR POWER DISTRIBUTION IN PIPING STRUCTURE

This application claims the benefit of U.S. Provisional Application No. 60/178,000, filed Jan. 24, 2000, the entire disclosure of which is hereby incorporated by reference.

TECHNICAL FIELD OF THE INVENTION

The present invention relates to the use of at least one unpowered induction choke to form an electrical circuit in a piping structure. In one aspect, it relates to providing power and/or communications to a device downhole in a borehole of a well using an electrical circuit formed in a piping structure by using at least one unpowered induction choke.

CROSS-REFERENCES TO RELATED APPLICATIONS

This application claims the benefit of the U.S. Provisional Applications in the following table, all of which are hereby incorporated by reference:

U.S. PROVISIONAL APPLICATIONS

| T&K # | Ser. No. | Title | Filing Date |
|---|---|---|---|
| TH 1599 | 60/177,999 | Toroidal Choke Inductor for Wireless Communication and Control | Jan. 24, 2000 |
| TH 1599x | 60/186,376 | Toroidal Choke Inductor for Wireless Communication and Control | Mar. 2, 2000 |
| TH 1600 | 60/178,000 | Ferromagnetic Choke in Wellhead | Jan. 24, 2000 |
| TH 1600x | 60/186,380 | Ferromagnetic Choke in Wellhead | Mar. 2, 2000 |
| TH 1601 | 60/186,505 | Reservoir Production Control from Intelligent Well Data | Mar. 2, 2000 |
| TH 1602 | 60/178,001 | Controllable Gas-Lift Well and Valve | Jan. 24, 2000 |
| TH 1603 | 60/177,883 | Permanent, Downhole, Wireless, Two-Way Telemetry Backbone Using Redundant Repeater, Spread Spectrum Arrays | Jan. 24, 2000 |
| TH 1668 | 60/177,998 | Petroleum Well Having Downhole Sensors, Communication, and Power | Jan. 24 2000 |
| TH 1669 | 60/177,997 | System and Method for Fluid Flow Optimization | Jan. 24, 2000 |
| TS 6185 | 60/181,322 | Optimal Predistortion in Downhole Communications System | Feb. 9, 2000 |
| TH 1671 | 60/186,504 | Tracer Injection in a Production Well | Mar. 2, 2000 |
| TH 1672 | 60/186,379 | Oilwell Casing Electrical Power Pick-Off Points | Mar. 2, 2000 |
| TH 1673 | 60/186,394 | Controllable Production Well Packer | Mar. 2, 2000 |
| TH 1674 | 60/186,382 | Use of Downhole High Pressure Gas in a Gas Lift Well | Mar. 2, 2000 |
| TH 1675 | 60/186,503 | Wireless Smart Well Casing | Mar. 2, 2000 |
| TH 1677 | 60/186,527 | Method for Downhole Power Management Using Energization from Distributed Batteries or Capacitors with Reconfigurable Discharge | Mar. 2, 2000 |
| TH 1679 | 60/186,393 | Wireless Downhole Well Interval Inflow and Injection Control | Mar. 2, 2000 |

-continued

U.S. PROVISIONAL APPLICATIONS

| T&K # | Ser. No. | Title | Filing Date |
|---|---|---|---|
| TH 1681 | 60/186,394 | Focused Through-Casing Resistivity Measurement | Mar. 2, 2000 |
| TH 1704 | 60/186,531 | Downhole Rotary Hydraulic Pressure for Valve Actuation | Mar. 2, 2000 |
| TH 1705 | 60/186,377 | Wireless Downhole Measurement and Control For Optimizing Gas Lift Well and Field Performance | Mar. 2, 2000 |
| TH 1722 | 60/186,381 | Controlled Downhole Chemical Injection | Mar. 2, 2000 |
| TH 1723 | 60/186,378 | Wireless Power and Communications Cross-Bar Switch | Mar. 2, 2000 |

The current application shares some specification and figures with the following commonly owned and concurrently filed applications in the following table, all of which are hereby incorporated by reference:

COMMONLY OWNED AND CONCURRENTLY FILED U.S. PATENT APPLICATIONS

| T&K # | Ser. No. | Title | Filing Date |
|---|---|---|---|
| TH 1599US | 09/769,047 | Toroidal Choke Inductor for Wireless Communications and Control | Jan. 24, 2001 |
| TH 1602US | 09/768,705 | Controllable Gas-Lift Well and Valve | Jan. 24, 2001 |
| TH 1603US | 09/768,655 | Permanent, Downhole, Wireless, Two-Way Telemetry Backbone Using Redundant Repeaters | Jan. 24, 2001 |
| TH 1668US | 09/769,046 | Petroleum Well Having Downhole Sensors, Communication, and Power | Jan. 24, 2001 |
| TH 1669US | 09/768,656 | System and Method for Fluid Flow Optimization | Jan. 24, 2001 |

BACKGROUND OF THE INVENTION

Several methods have been devised to place controllable valves and other devices and sensors downhole on a tubing string in a well, but all such known devices typically use an electrical cable along the tubing string to power and communicate with the devices and sensors. It is undesirable and in practice difficult to use a cable along the tubing string either integral with the tubing string or spaced in the annulus between the tubing and the casing because of the number of failure mechanisms are present in such a system. Other methods of communicating within a borehole are described in U.S. Pat. Nos. 5,493,288; 5,576,703; 5,574,374; 5,467,083; and 5,130,706.

U.S. Pat. No. 6,070,608 describes a surface controlled gas lift valve for use in oil wells. Methods of actuating the valve include electro-hydraulic, hydraulic, and pneumo-hydraulic. Sensors relay the position of the variable orifice and critical fluid pressures to a panel on the surface. However, when describing how electricity is provided to the downhole sensors and valves, the means of getting the electric power/signal to the valves/sensors is described as an electrical conduit that connects between the valve/sensor downhole and a control panel at the surface. U.S. Pat. No. 6,070,608 does not specifically describe or show the current path from the device downhole to the surface. The electrical conduit is shown in the figures as a standard electrical conduit, i.e., an extended pipe with individual wires protected therein, such that the pipe provides physical protection and the wires therein provide the current path. But such standard electrical conduits can be difficult to route at great depths, around turns for deviated wells, along multiple branches for a well having multiple lateral branches, and/or in parallel with coiled production tubing. Hence, there is a need for a system and method of providing power and communications signals to downhole devices without the need for a separate electrical conduit filled with wires and strung along side of production tubing.

U.S. Pat. No. 4,839,644 describes a method and system for wireless two-way communications in a cased borehole having a tubing string. However, this system describes a downhole toroid antenna for coupling electromagnetic energy in a waveguide TEM mode using the annulus between the casing and the tubing. This toroid antenna uses an electromagnetic wave coupling that requires a substantially nonconductive fluid (such as refined, heavy oil) in the annulus between the casing and the tubing as a transmission medium, as well as a toroidal cavity and wellhead insulators. Therefore, the method and system described in U.S. Pat. No. 4,839,644 is expensive, has problems with brine leakage into the casing, and is difficult to use for downhole two-way communication. Thus, a need exists for a better system and method of providing power and communications signals to downhole devices without the need for a nonconductive fluid to be present in the annulus between the casing and tubing.

Other downhole communication concepts, such as mud pulse telemetry (U.S. Pat. Nos. 4,648,471 and 5,887,657), have shown successful communication at low data rates but are of limited usefulness as a communication scheme where high data rates are required or it is undesirable to have complex, mud pulse telemetry equipment downhole. Still other downhole communication methods have been attempted, see U.S. Pat. Nos. 5,467,083; 4,739,325; 4,578,675; 5,883,516; and 4,468,665. Hence, there is a need for a system and method of providing power and communications signals to downhole devices at higher data rates and with available power to operate a downhole device.

It would, therefore, be a significant advance in the operation of petroleum wells if tubing, casing, liners, and/or other conductors installed in wells could be used for the communication and power conductors to control and operate devices and sensors downhole in a petroleum well.

Induction chokes have been used in connection with sensitive instrumentation to protect against surges and stray voltage. For example, most personal computers have some sort of choke incorporated into its AC power cord for such protection. Such protection chokes work well for their intended purpose, but do not operate to define a power or communication circuit.

All references cited herein are incorporated by reference to the maximum extent allowable by law. To the extent a reference may not be fully incorporated herein it is incorporated by reference for background purposes, and indicative of the knowledge of one of ordinary skill in the art.

SUMMARY OF THE INVENTION

The problems and needs outlined above are largely solved and met by the present invention. In accordance with a first aspect of the present invention, a current impedance device for routing a time-varying electrical current in a piping structure is provided. The current impedance device comprises an induction choke that is generally concentric about a portion of the piping structure, such that during operation a voltage potential forms between the piping structure and an electrical return when the time-varying electrical current is transmitted through and along the portion of the piping structure, and such that during operation part of the current can be routed through a device electrically connected to the piping structure due to the voltage potential formed. The induction choke may be unpowered and may comprise a ferromagnetic material. The induction choke can be generally cylindrical shaped with a generally cylindrical shaped borehole formed therethrough. The choke may be enclosed within an insulating shell.

In accordance with a second aspect of the present invention, a system for defining an electrical circuit is provided. The system comprises a piping structure, a source of time-varying current, an induction choke, a device, and an electrical return. The piping structure comprises a first location, a second location, and an electrically conductive portion extending between the first and second locations. The first and second locations are distally spaced along the piping structure. The source of time-varying current is electrically connected to the electrically conductive portion of the piping structure at a location along the first location. The induction choke is located about part of the electrically conductive portion of the piping structure. The device comprises two terminals. A first of the device terminals is electrically connected to the electrically conductive portion of the piping structure. The electrical return electrically connects between a second of the device terminals and the source to complete the electrical circuit. When applying the system in a petroleum well for example, the first location is near the surface and the second location is downhole in a borehole of the well.

In an embodiment of the system in accordance with the second aspect of the present invention, the choke can be located along the second location, and the electrical connection location for the first device terminal can be between the choke and the electrical connection location for the source.

Another embodiment of the system in accordance with the second aspect can further comprise a second induction choke located about a portion of the piping structure along the first location, such that the source is connected to the piping structure between the chokes. Yet another embodiment of the system further comprises an electric power transformer located about a portion of the piping structure between the electrical connection location for the source and the second choke.

Still another embodiment of the system in accordance with the second aspect can further comprise an electric power transformer located about a portion of the piping structure between the electrical connection location for the source and the choke. The electric power transformer may comprise a ferromagnetic toroid wound by wire such that the wire is generally parallel to a central axis of the toroid when wound about the toroid.

In a further embodiment of the system in accordance with the second aspect of the present invention, the choke is located along the first location, the electrical connection location for the first device terminal is along the second location, and the electrical connection location for the source is between the choke and the electrical connection location for the first device terminal. A still further embodiment can further comprise a second induction choke located about a portion of the piping structure along the second location, such that the electrical connection location for the source is between the chokes, and such that the electrical connection location for the first device terminal is between the second choke and the electrical connection location for the source.

Another embodiment of the system in accordance with the second aspect further comprises an electric power transformer located about a portion of the piping structure, such that the electrical connection location for the source is between the choke and the transformer.

In accordance with a third aspect of the present invention, a system for providing power or communications to a remote device is provided. The system comprises a piping structure, an induction choke, an electric power transformer, a source of time-varying current, a device, and an electrical return. The piping structure comprises a first location, a second location, and an electrically conductive portion extending between the first and second locations. The first and second locations are distally spaced along the piping structure. The induction choke is located about a portion of the piping structure. The source of time-varying current is electrically connected to the electrically conductive portion of the piping structure for supplying primary electrical current. The transformer is located about a portion of the piping structure and adapted to form a secondary coil for supplying secondary electrical current corresponding to the primary electrical current when the primary electrical current is flowing in the electrically conductive portion of the piping structure, wherein the electrically conductive portion of the piping structure acts as a primary coil. The electrical return electrically connects between the electrically conductive portion of the piping structure and the source to complete an electrical circuit, such that the transformer is located between the electrical connection location for the source and the electrical connection location for the electrical return along the piping structure. The device is electrically connected to the transformer for receiving the secondary electrical current. Hence, when the system is operable, the device can receive power, and/or send or receive communication signals, via the transformer and the electrical circuit formed.

In an embodiment of the system in accordance with a third aspect of the present invention, the choke can be located along the first location, and the electrical connection location for the source can be located between the choke and the transformer. Also, the transformer can be located along the first location or the second location. The embodiment can further comprise a second induction choke located about a portion of the piping structure along the second location, such that the transformer is located between the chokes. In another embodiment of the system in accordance with the third aspect, the choke can be located along the second location, and the electrical connection location for the source can be located along the first location. The electrical connection location for the electrical return can be located between the transformer and the choke, or the choke can be located between the transformer and the electrical connection location for the electrical return. The embodiment can further comprise an electrical insulator along the first location, such that the electrical connection location for the source is between the insulator and the transformer. The insulator can comprise an insulated hanger.

In accordance with a fourth aspect of the present invention, a petroleum well for producing petroleum products is provided. The petroleum well comprises a piping structure and an electrical circuit. The piping structure comprises a first location, a second location, and an electrically conductive portion extending between the first and second locations. The first and second locations are distally spaced along the piping structure. The electrical circuit comprises the electrically conductive portion of the piping structure, a source of time-varying current, an induction choke, a device, and an electrical return. The source of time-varying current is electrically connected to the electrically conductive portion of the piping structure at a location along the first location. The induction choke is located about part of the electrically conductive portion of the piping structure. The device comprises two terminals, a first of the device terminals being electrically connected to the electrically conductive portion of the piping structure. The electrical return electrically connects between a second of the device terminals and the source to complete the electrical circuit.

The piping structure can comprise at least a portion of a production tubing string, at least a portion of a pumping rod, at least a portion of a well casing, at least a portion of at least one branch forming a lateral extension of a well, at least a portion of an oil refinery piping network, at least a portion of above surface refinery production pipes, or any combination thereof. The electrical return can comprise at least a portion of a well casing, at least a portion of an earthen ground, a conductive fluid, a packer, at least a portion of another piping structure of a same well, at least a portion of another piping structure of another well, or any combination thereof.

BRIEF DESCRIPTION OF THE DRAWINGS

Other objects and advantages of the invention will become apparent upon reading the following detailed description and upon referencing the accompanying drawings, in which.

DETAILED DESCRIPTION OF THE INVENTION

Figure 1:
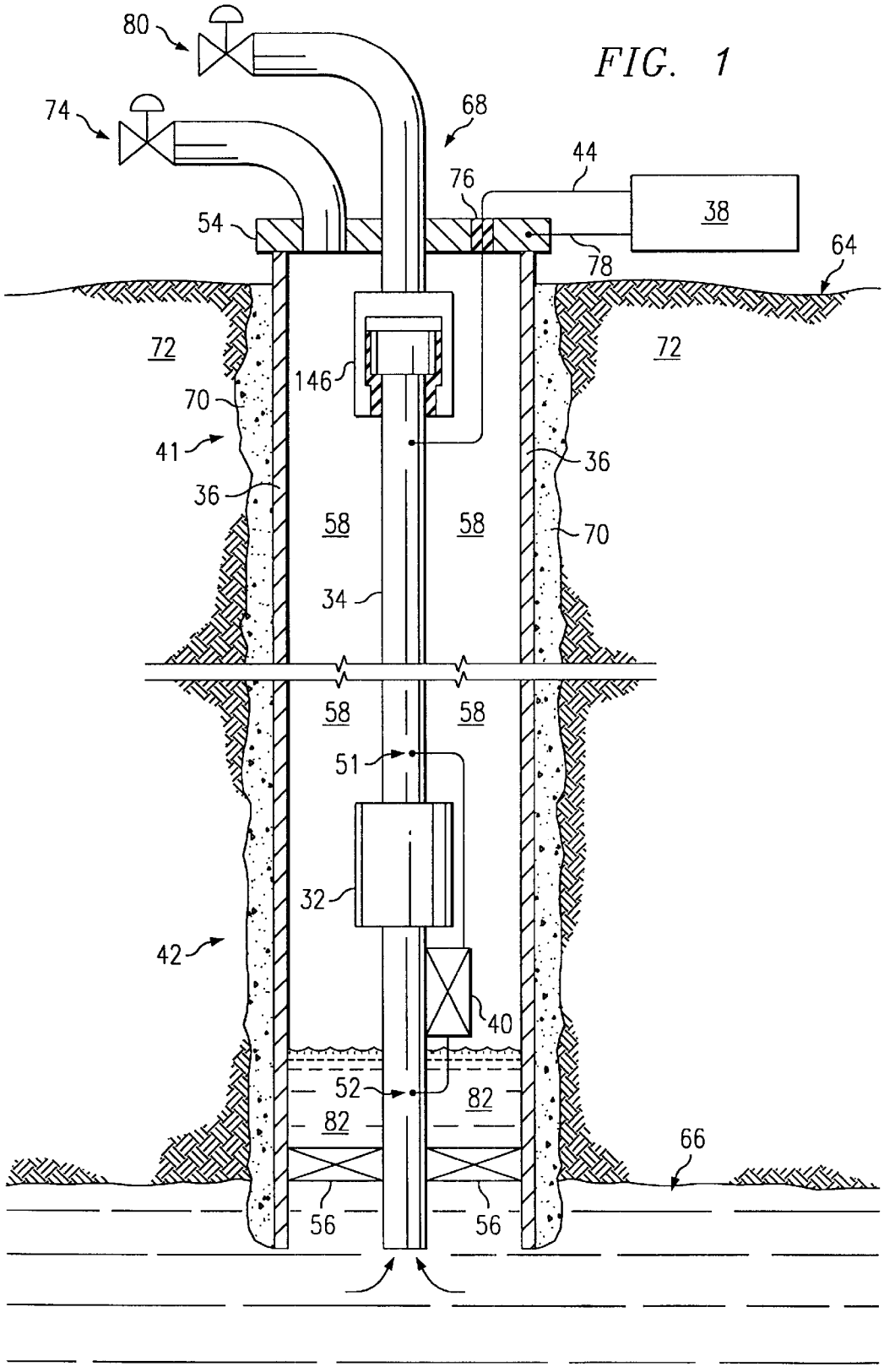
FIG. 1 is a schematic of a petroleum well illustrating the general disposition of the major elements of the present invention in relation to the major elements of a conventional well.

Referring now to the drawings, wherein like reference numbers are used to designate like elements throughout the various views, several embodiments of the present invention are further described. The figures are not necessarily drawn to scale, and in some instances the drawings have been exaggerated or simplified for illustrative purposes only. One of ordinary skill in the art will appreciate the many possible applications and variations of the present invention based on the following examples of possible embodiments of the present invention and cited patents and articles incorporated by reference.

The terms "first end" and "second end" as used herein are defined generally to call out a side or portion of a piping structure, which may or may not encompass the most proximate locations, as well as intermediate locations along a called out side or portion of the piping structure. Similarly, in accordance with conventional terminology of oilfield practice, the descriptors "upper", "lower", "uphole" and "downhole" refer to distance along the borehole from the surface, which in deviated wells may or may not accord with relative vertical placement measured with reference to the ground surface.

Also, the term "wireless" as used in this application means the absence of a conventional, insulated wire conductor e.g. extending from a downhole device to the surface. Using the tubing and/or casing as a conductor is considered "wireless."

Also, the term "modem" as used herein is not limited to conventional computer modems that convert digital signals to analog signals and vice versa (e.g., to send digital data signals over the analog Public Switched Telephone Network). For example, if a sensor puts out measurements in an analog format, then such measurements may only need to be used to modulate a carrier frequency and be transmitted—hence no analog/digital conversion needed. As another example, a relay/slave modem or communication device may only need to identify, filter, amplify, and/or retransmit a signal received.

As used in the present application, a "valve" is any device that functions to regulate the flow of a fluid. Examples of valves include, but are not limited to, bellows-type gas-lift valves and controllable gas-lift valves, each of which may be used to regulate the flow of lift gas into a tubing string of a well. The internal workings of valves can vary greatly, and in the present application, it is not intended to limit the valves described to any particular configuration, so long as the valve functions to regulate flow. Some of the various types of flow regulating mechanisms include, but are not limited to, ball valve configurations, needle valve configurations, gate valve configurations, and cage valve configurations. The methods of installation for valves discussed in the present application can vary widely. Valves can be mounted downhole in a well in many different ways, some of which include tubing conveyed mounting configurations, side-pocket mandrel configurations, or permanent mounting configurations such as mounting the valve in an enlarged tubing pod.

The term "sensor" as used herein refers to any device that detects, determines, monitors, records, or otherwise senses the absolute value of or a change in a physical quantity. Sensors as described in the present application can be used to measure temperature, pressure (both absolute and differential), flow rate, seismic data, acoustic data, pH level, salinity levels, valve positions, or almost any other physical data.

In the first embodiment shown in FIG. 1, the piping structure comprises a production tubing string 34 for a well, which is typically steel tubing. The system has an electrical impeding device 146 located about the tubing 34 along a first end 41 near the surface. Device 146 may consist of an electrically insulating joint as shown in FIG. 1, or an unpowered choke of the present invention. A lower choke 32 is located about the tubing along a second end 42 downhole within the well. The source of time-varying current 38 is electrically connected to the tubing 34 between the impeding devices 146, 32. The time-varying current can be alternating current (AC) or a varying direct current (DC), but AC is typically more practical in use. AC power and communications signals from the source 38 are connected to the tubing 34 via an insulating feedthrough 76. The device 40 comprises two terminals 51, 52. A device terminal is defined generally as an electrical connection point for a device, which may include but is not limited to: a wire, a device enclosure, a prong, a pin, a contact pad, a solder point, a female receptacle, a shaft, or any combination thereof. A first device terminal 51 is electrically connected to the tubing 34 downhole between the connection location for the source of current 38 and the lower choke 32.

A second device terminal 52 is also electrically connected to the tubing 34, but at a location on an opposite side of the lower choke 32 relative to the electrical connection location for the first device terminal 51. As described further below with equations, a voltage potential exists across the choke 32 when a time-varying current flows through the tubing. Hence, the device 40 is electrically connected across the voltage potential on the tubing developed by the choke 32 when AC flows in the tubing 34, which provides current flow through the device 40.

Device 146 may consist of an electrically insulating joint hanger, or a choke in accordance with the present invention. While electrically insulating joint hangers provide true electrical isolation, they must sustain significant mechanical loads on insulating materials such as plastics or ceramics, and are therefore subject to damage from those loads. Chokes cannot provide complete isolation, but are able to sustain high mechanical loads since they are constructed such that all the load-bearing elements are composed of metal.

At least a portion of the well casing 36 is electrically conductive. The electrically conductive portion of the well casing 36 is electrically connected to the tubing 34 (e.g., via conductive fluid 82 and/or packer 56) and the source of current 38. Hence, the electrically conductive portion of the well casing 36 acts as part of an electrical return to complete the electrical circuit.

Where centralizers are used to control the position of the tubing 34 relative to the casing 36, such centralizers which are disposed between devices 146 and 32 must not be electrically conductive. Suitable centralizers are typically composed of molded or machined plastic.

Therefore, the electrical circuit is formed by the system of the first embodiment, wherein the time-varying current (e.g., AC) can flow from the power source 38 to the tubing 34, along the tubing 34 between the device 146 and the choke 32, through the device 40 to the tubing 34 below the lower choke 32, to the casing 36 via the packer 56 and/or the conductive fluid 82, and along the well casing 36 to the source 38 to complete the electrical circuit. Thus, the downhole device 40 can receive power, as well as send/receive communication signals, using the tubing 34 between the upper and lower devices 146, 32 as one of the primary conductors and as a power and/or communications path.

In the application of the first embodiment shown in FIG. 1, the gas-lift oil well extends from the surface 64 through a borehole and extends into a production zone 66 downhole. A production platform 68 is schematically illustrated above the surface 64. A hanger 54 supports the production tubing string 34 from the well casing 36. The casing 36 is conventional, i.e., it is typically metal tubing held in place by injecting cement 70 between the casing and the earth in the borehole during well completion. Similarly the tubing string 34 is generally conventional comprising a plurality of elongated tubular metal production pipe sections joined by threaded couplings (not shown) at each end of each tubing section. A gas input throttle 74 is employed to permit the input of compressed gas into the tubing 34 via one or more valves contained within pod 40 for lifting oil during production. Schematically illustrated is a computer system and power source 38 at the surface 64 with power and communication feeds 44 passing through electrically isolating pressure seal 76 and using return connection 78, which is electrically connected to the casing 36. The degree of opening of a gas lift valve may be controlled by means of setpoint commands sent by communication from the surface modem to the downhole modem and interpreted by a downhole control interface for the motor of the gas lift valve. Sensor readings from the downhole pod may either be processed locally within the pod to provide autonomous control, or the sensor readings may be conveyed to the surface by means of the communications between the downhole and surface modems, for analysis at the surface.

The choke 32 is unpowered and made from a material having a high magnetic permeability (e.g., a relative permeability of 1000 to 150,000), such as a ferromagnetic metal alloy or a ferrite. The choke 32 is electrically insulated from the tubing 34 and acts to create a reactive impedance to AC flow in the tubing. In the case where the upper device 146 is a choke (rather than an electrically insulating joint), its action and construction is essentially the same as the lower choke 32. The choke 32 (and 146 in the case where it is a choke) are mounted concentric and external to the tubing 34 and are typically coated with shrink-wrap plastic to provide electrical insulation, and may additionally be enclosed within with an epoxy shell (not shown) to withstand rough handling and corrosive conditions. As described in the mathematical analysis below, the size and material of chokes can be chosen to achieve a desired series impedance value.

Figure 2:
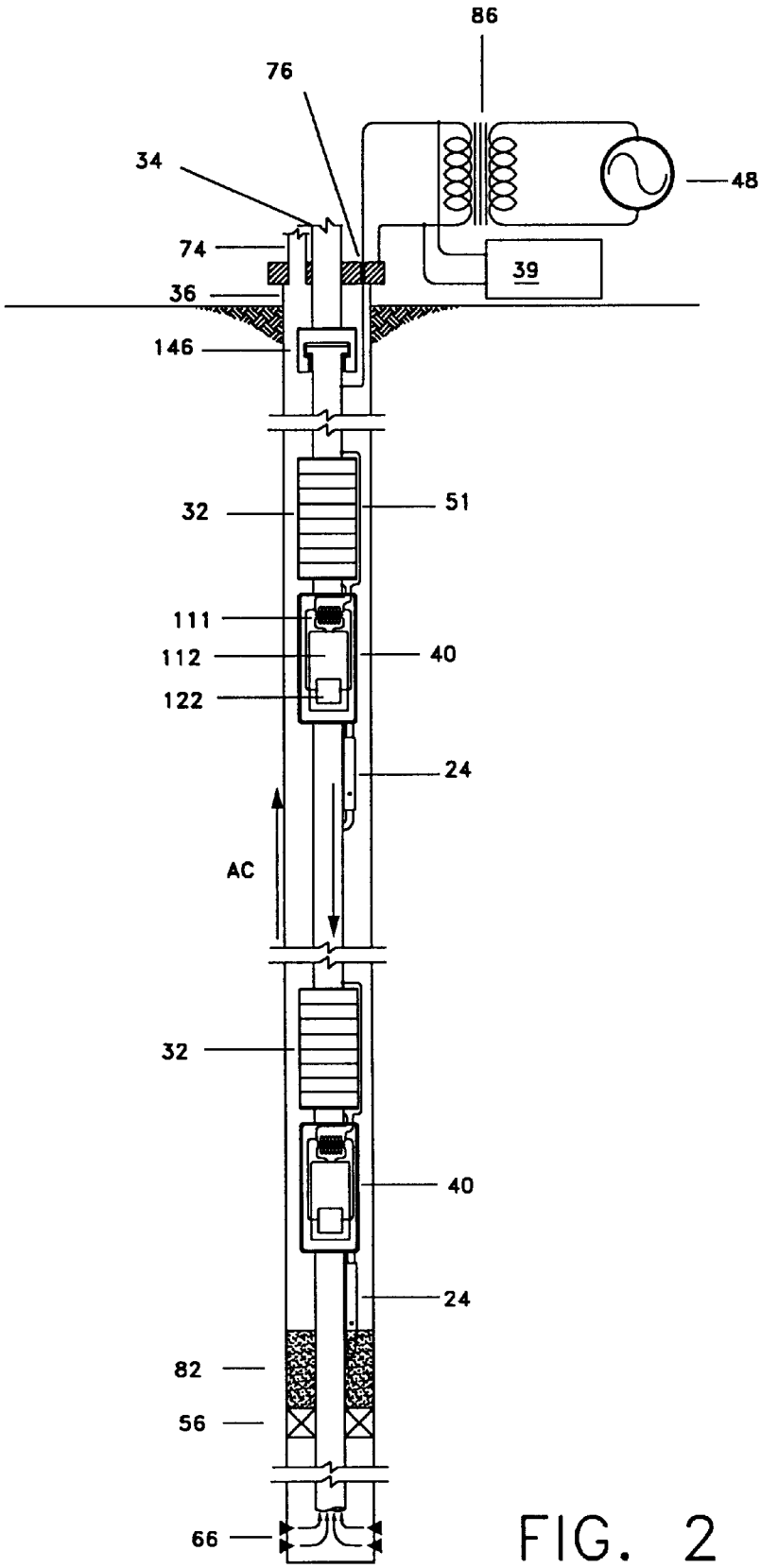
FIG. 2 is related to FIG. 1 and shows in more detail a petroleum well incorporating electrical chokes and associated communication, measurement and control equipment in accordance with the methods of the present invention.

FIG. 2 illustrates in greater detail the preferred embodiment of the invention outlined in FIG. 1 as it is applied to a gas-lift oil well. FIG. 2 illustrates such a well consisting of casing 36 extending from the surface and containing production tubing 34. At the well head the upper portion of the production tubing is electrically isolated from the lower portion by means of an electrically insulating joint hanger 146. At depth within the well the annular space between casing 36 and tubing 34 contains completion fluid 82, and an electrically conductive packer 56 which hydraulically isolates the completion fluid from the production zone 66. Fluids from the production zone 66 are conveyed to the surface by passage through the production tubing 34. In FIG. 2 the disposition of two chokes 32 are shown at depth within the well, each of which is used to power electrical pods 40. These pods implement any combination of communication, measurement and control functions to assist well production operations.

Referring still to FIG. 2, the general disposition of surface equipment is illustrated, consisting of an AC power source 48, a 1:10 power transformer 86, and a modem 39. One output side of the surface power transformer and modem circuits are connected by means of conductor 44 through a pressure sealed electrical isolation feedthrough 76 to the production tubing section below the electrically isolating hanger. The other output sides of the power transformer and the surface master modem circuits are electrically connected to the well casing.

FIG. 2 shows each pod being used to power and control a motorized gas lift valve 24. For this purpose a suitable implementation of the pod consists of a power transformer 111 with a winding ratio such that 2 Volts on the tubing side creates 15 Volts on the electronics module side (and vice versa), and a main printed circuit board (PCB) 112 having a modem 122 and other electrical components to power and control the motorized gas lift valve 24. The downhole modems within the pods communicate with the modem at the surface, and possibly with each other, allowing data to be transferred from each pod to the surface or between pods, and instructions to be passed from the surface to control each gas lift valve. Each modem is individually addressable, and each control or sensor device within each pod is individually addressable.

While FIG. 2 illustrates the case where two downhole modules are operated in the well, it will be readily apparent that the same principle may be used to provide an arbitrary number of downhole modules. This is useful in an application where a conductive completion fluid 82 is present in the annulus before unloading a gas-lift well. Each choke will not work sufficiently to develop a voltage potential at its respective device when the choke is submerged in conductive fluid, but as the conductive fluid is progressively removed during the unloading process, each device can receive power and/or communications (thus being controllable) when the respective choke is no longer submerged in conductive fluid. Hence, as the conductive fluid level drops during unloading, the devices sequentially become controllable, which aids in achieving a more controlled unloading procedure.

Figure 3:
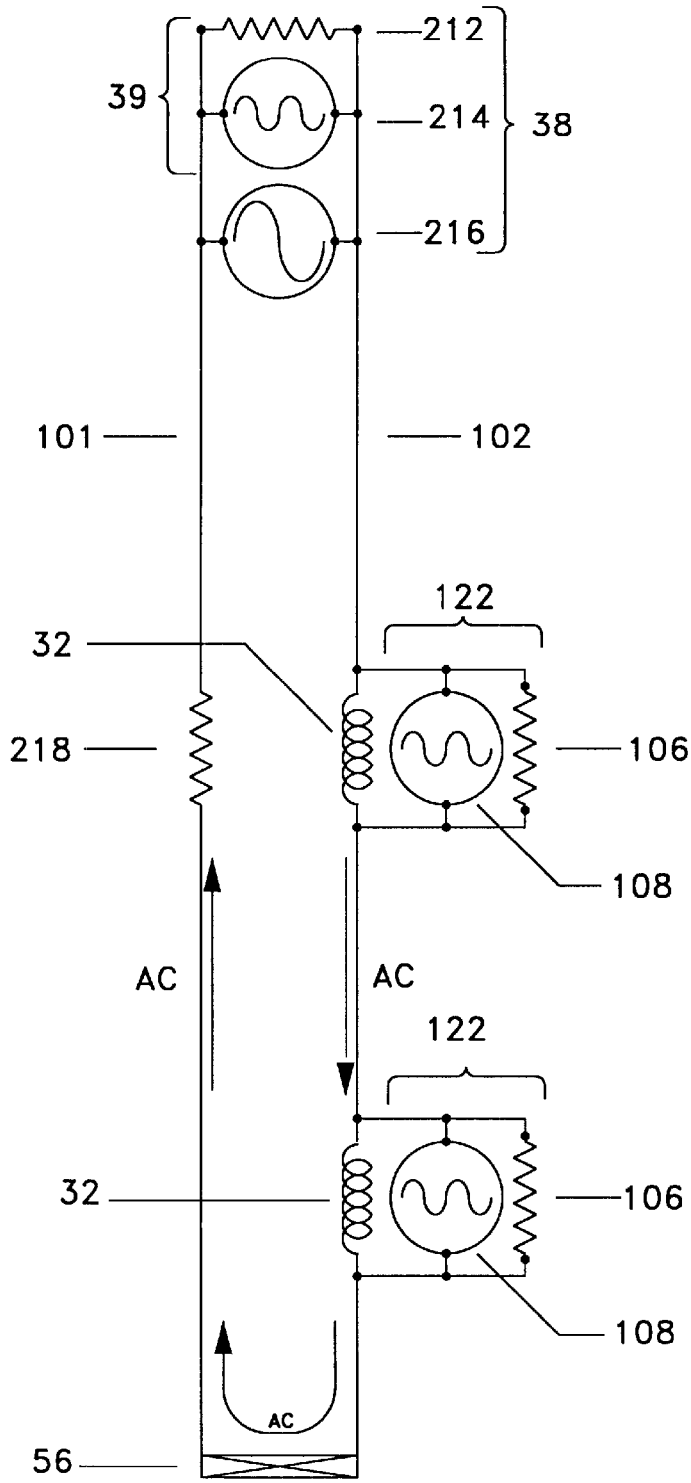
FIG. 3 is related to FIG. 2, and shows the electrical equivalent circuit of that well.

Referring to FIG. 3, the electrical equivalent circuit of the power and communications path of FIG. 2 may be analyzed. The casing and tubing form the major transmission paths for both the power and communication signals. The casing is represented by the conductor 101. The tubing is represented by conductor 102. Resistor 218 represents the combined distributed resistance offered by casing and tubing, and is typically of the order of 1 Ohm. The choke impedances are represented by inductors 32. At the frequency of the AC power the reactive impedance offered by each choke is of the order of 2 Ohms.

Referring still to FIG. 3, the surface master modem ensemble 39 is represented by resistor 212 for its receiver, and an AC source 214 for its transmitter. AC power input at the surface is represented by AC source 216. The downhole electronic pods associated with each choke are represented by power converter and modem ensembles 122, composed of resistors 106 for the power converters and modem receivers, and AC sources 108 for the modem transmitters. The circuit is completed by the metal packer 56 which has a negligibly small electrical impedance.

It is seen from FIGS. 2 and 3 that the downhole pods are powered by the AC voltage developed on the tubing by each choke, caused by the back-EMF created by the passage of current along the tubing which passes through the choke. The chokes are designed to develop about 2 Volts from the AC which passes through them, and this AC is converted to DC in the power conditioning circuit which is coupled through the power supply input transformer, following standard practice for such AC-to-DC power conversion and conditioning circuits. This DC power is typically supplied to the pod sensors, modem, and control circuits at about 15 Volts, and of the order of 10 Watts is typically available to power these downhole sub-systems.

Figures 4A, 4B:
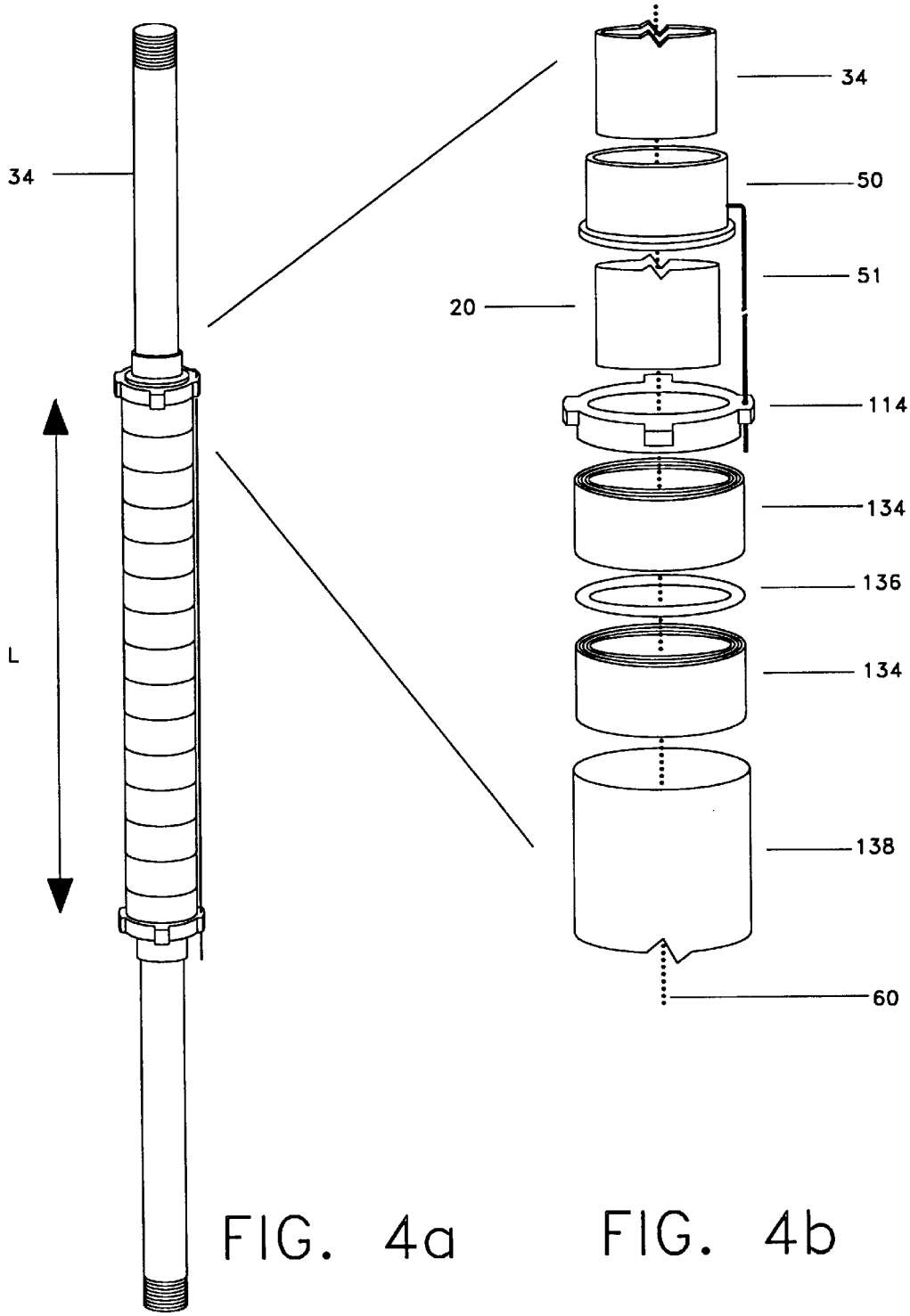
FIG. 4*a* is related to FIG. 2, and shows the overall assembly of one of the chokes of FIG. 1.
FIG. 4*b* is related to FIG. 4*a,* and shows in detail the components used in the construction of the choke assembly of FIG. 4*a;*

Referring to FIG. 4*a,* the construction of a suitable choke may be described. A choke for a given application may be divided into multiple pieces along its length (L). In other words, stacking multiple sub-sections of chokes 134 together along the choke axis 60, as shown in FIGS. 4*a* and 4*b,* provides the same effect as have one large choke of length (L). Multiple sub-sections 134 stacked on top of one another act as a series of impedances, which added together provide the same total impedance as a single choke having the same total length of ferromagnetic material as the aggregated sub-sections.

Referring to FIG. 4*b,* the details of a suitable choke assembly are illustrated, though it will be clear to one familiar with the art that alternative designs are feasible. The tubing section 34 is composed of type 316 stainless steel and typically has an outer diameter of 3.5 inches and a length of 10 feet. Each end of the production tubing section 34 is furnished with New VAM male threads by which mating sections of conventional production tubing are attached. (New VAM is a registered Trademark of Vallourec Mannesman Oil & Gas France, and defines a thread form suitable for this purpose). At the upper and lower extremities of the choke section are welding collars 50 with internal diameter 3.55 inches, length 2 inches, and wall thickness one quarter of an inch. The section of tubing 34 between the welding collars is covered with PTFE heat-shrink tubing 20 of 0.020 inches wall thickness, and thus tubing 20 lies between the production tubing section 34 and the internal walls of all the choke sub-sections 134. Each end of the choke assembly is furnished with a machined plastic centralizer 114. A suitable machinable plastic is polyetheretherketone (PEEK) which is a commodity material available from many commercial sources Choke sub-sections 134 are formed by winding 60 sheet laminations of a high-permeability ferromagnetic alloy such as Permalloy (Permalloy is a registered Trademark, of Western Electric Company). Permalloy is a nickel/iron alloy with a nickel content in the range 35% to 90% and is available as a commodity material from many commercial sources. A suitable alloy is composed of 86% nickel/14% iron, and the laminations are 0.014 inches thick and 2.35 inches wide such that the final dimensions of each choke section are 3.6 inches internal diameter, 5.45 inches external diameter, and 2.35 inches in the direction of the choke axis 60. Fifteen such choke sections are stacked to form a total choke assembly suitable for usual power frequencies, 50 or 60 Hertz. At power frequencies up to a few hundred Hertz, laminated ferromagnetic alloy can be used for construction of the choke sections, as in standard transformer design practice, and as described above. Lamination is required to reduce eddy current losses which would otherwise degrade the effectiveness of the choke. For material with absolute magnetic permeability of 50,000 operating at 60 Hertz the required lamination thickness for 2 skin depths is 0.8-millimeters (0.031 inches), which is realistic and practical.

Between each choke section is a polytetrafluoro-ethylene (PTFE) washer 136 with internal diameter 3.6 inches, external diameter 5.45 inches, and thickness 0.030 inches. After all the chokes are threaded onto the tubing, the entire section of chokes is covered with PTFE heatshrink tubing 138 having 0.020 inches wall thickness. The stainless steel rod 51 is 0.125 inches diameter covered with polyethylene (PE) heat-shrink tubing and extends along the length of the completed choke assembly. It is attached to the upper welding collar 10 and passes through holes in the centralizers 114. Its lower end is electrically connected to the input of the electrical pod which is below the choke assembly.

The impedance offered by the choke is a critical implementation issue, since this determines what proportion of total power supplied to the pipe will be lost to leakage through the choke, and what proportion will be available to power and communicate with the devices installed in the isolated section of the pipe. Since the impedance presented by an inductor increases with frequency, the AC power frequency is used in both the theoretical analysis and the testing of alternative choke configurations, as this is normally equal to or lower than the communication frequencies.

Figure 5A:
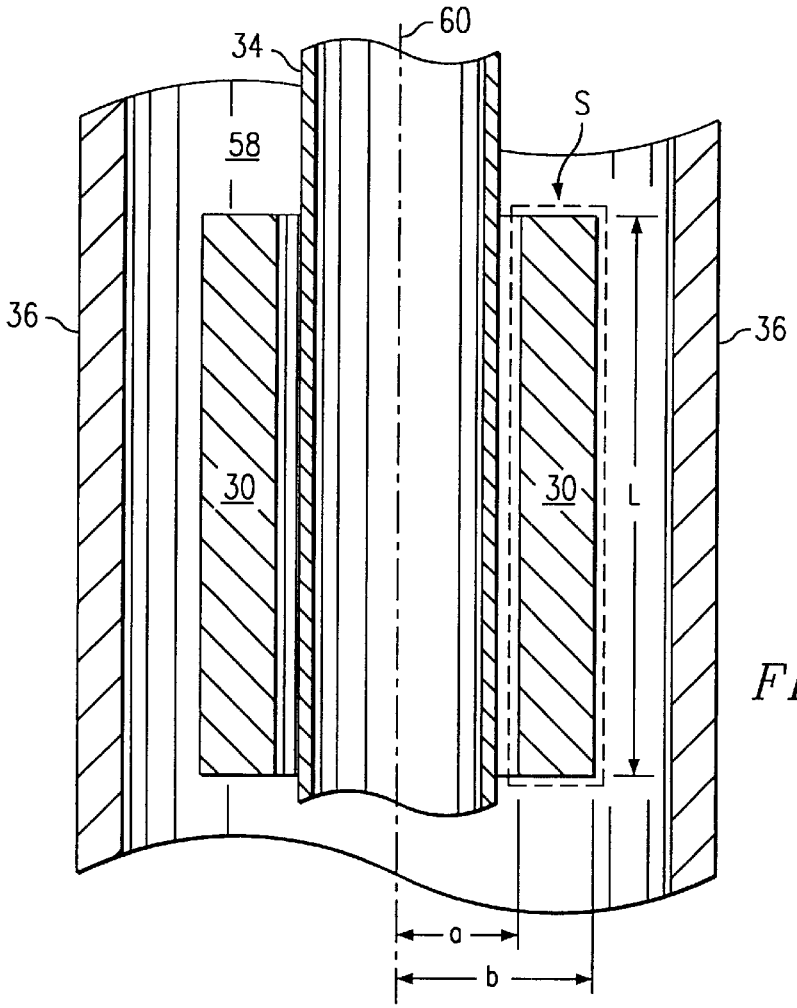
FIG. 5*a* is a longitudinal cross-section in partial section of a choke showing variables used in the design analysis of a choke disposed between tubing and casing.
Figure 5B:
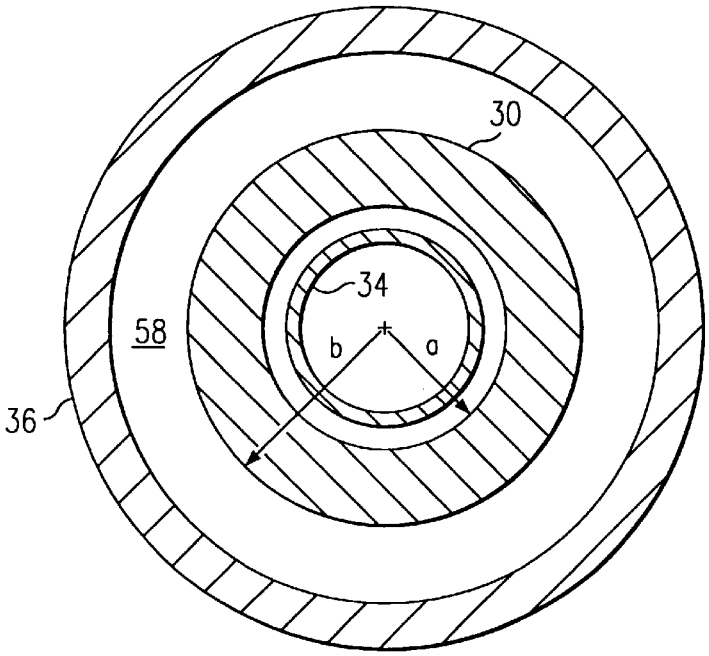
FIG. 5*b* is a radial cross-section of a choke showing variables used in the design analysis of a choke disposed between tubing and casing.
Figure 5C:
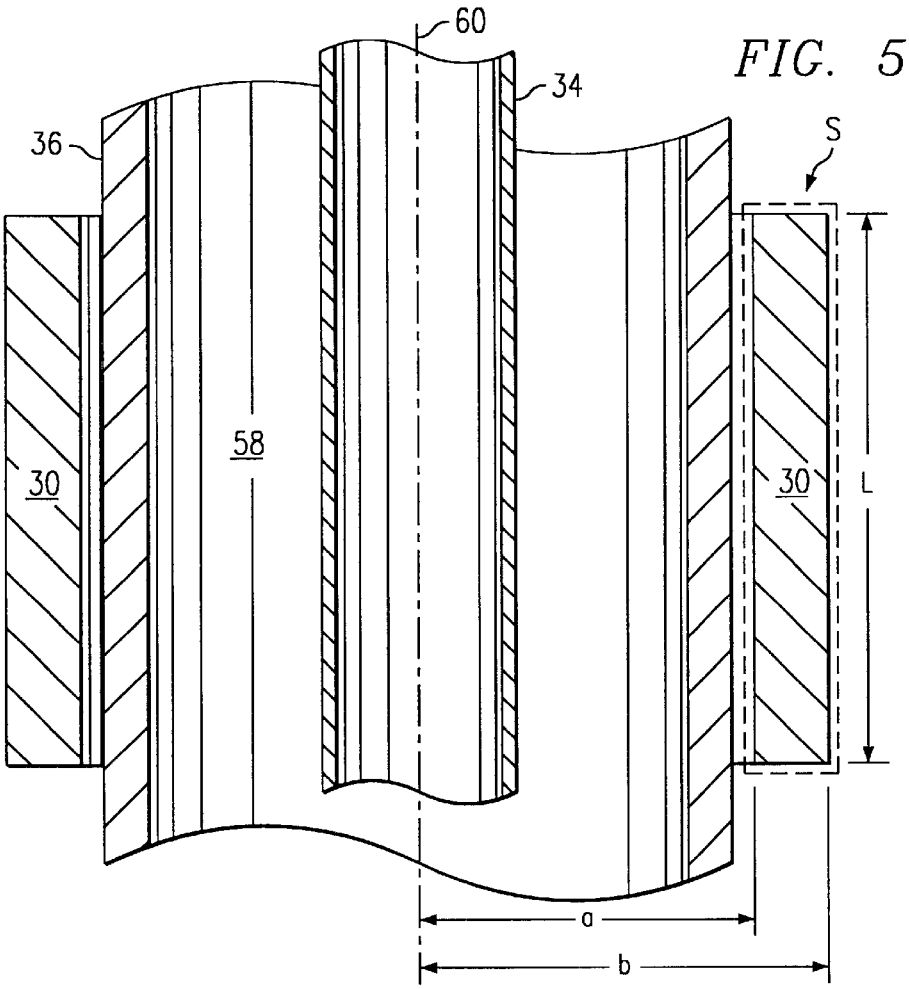
FIG. 5*c* is a longitudinal cross-section in partial section of a choke showing variables used in the design analysis of a choke external to both tubing and casing.
Figure 5D:
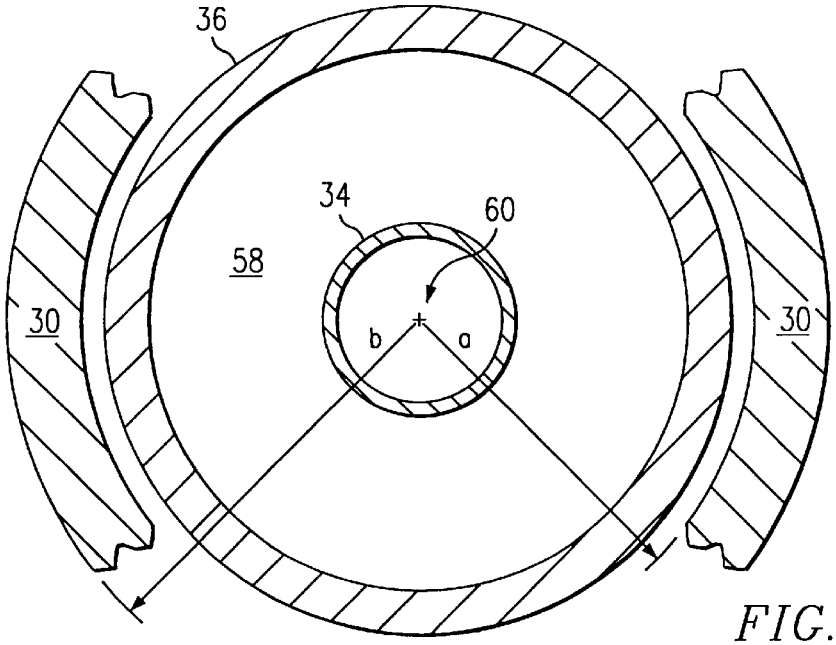
FIG. 5*d* is a radial cross-section of a choke showing variables used in the design analysis of a choke external to both tubing and casing.

FIGS. 5*a–d* indicate the parameters used in the choke design analysis. FIGS. 5*a* and 5*b* illustrate the case where the choke is placed within the annulus 58 between the tubing 34 and the casing 36. FIGS. 5*c* and 5*d* illustrate an alternative case where the choke is placed outside the casing 36. The basis for the analysis is the same in both cases, but it is important to realize that the electrical current value (I) used in the design analysis is the net current linked by the choke. In the case where the choke is disposed in the annulus 58 (FIGS. 5*a* and *b*), the current is that on the tubing alone. When the choke is disposed external to the casing (FIGS. 5*c* and 5*d*), the current is the vector sum of the separate currents on the casing and tubing. Thus if these currents were to be equal but opposite in phase there would be no net choking effect with the configuration shown in FIGS. 5*c* and 5*d*.

The defining variables and a self-consistent set of physical units are:

L=length of choke, meters;

a=choke inner radius, meters;

b=choke outer radius, meters;

r=distance from choke axis, meters;

I=r.m.s. net current through choked section, Amperes;

$\Omega$=angular frequency of leakage current, radians per second;

$\mu$=absolute magnetic permeability of choke material at radius r, equal to the absolute permeability of free space ($4\pi\times10^{-7}$ Henrys per meter) multiplied by the relative permeability of the magnetic material of the choke.

By definition, $\omega=2\pi f$ where f=frequency in Hertz.

At a distance r from the current I, the r.m.s. free space magnetic field H, in Henries per meter, is given by:

$$H=I/2\pi r$$

The field H is circularly symmetric about the choke axis, and can be visualized as magnetic lines of force forming circles around that axis.

For a point within the choke material, the r.m.s. magnetic field B, in Teslas, is given by:

$$B = \mu H = \mu I / 2\pi r$$

The r.m.s. magnetic flux F contained within the choke body, in Webers, is given by:

$$F = \int B dS$$

where S is the cross-sectional area of the choke in square meters as shown in FIGS. 5*a* and 5*c* and the integration is over the area S. Performing the integration from the inner radius of the choke (a), to the outer radius of the choke (b), over the length of the choke (L), we obtain:

$$F = \mu L I \ln(b/a)/2n$$

where 1n is the natural logarithm function.

The voltage generated by the flux F, in Volts, is given by:

$$V = \Omega F = 2\pi f F = \mu L I f \ln(b/a)$$

Note that the back-e.m.f. (V) is directly proportional to the length (L) of the choke for constant values of (a) and (b), the choke element internal and external radii. Thus by altering the length of the choke, any desired back-e.m.f. can be generated for a given current.

Inserting representative values:

$\mu = 50{,}000 \times (4\pi \times 10^{-7})$, L=1 meter, I=10 Amperes, f=60 Hertz, a=0.045 meters (3.6 inch inner diameter), b=0.068 meters (5.45 inch external diameter):

then the back-e.m.f. developed V=2.6 Volts showing that such a choke is effective in developing the required downhole voltage, and does so when realistic and safe currents and voltages are impressed upon the tubing and transmitted from the well head to downhole equipment.

Figure 6:
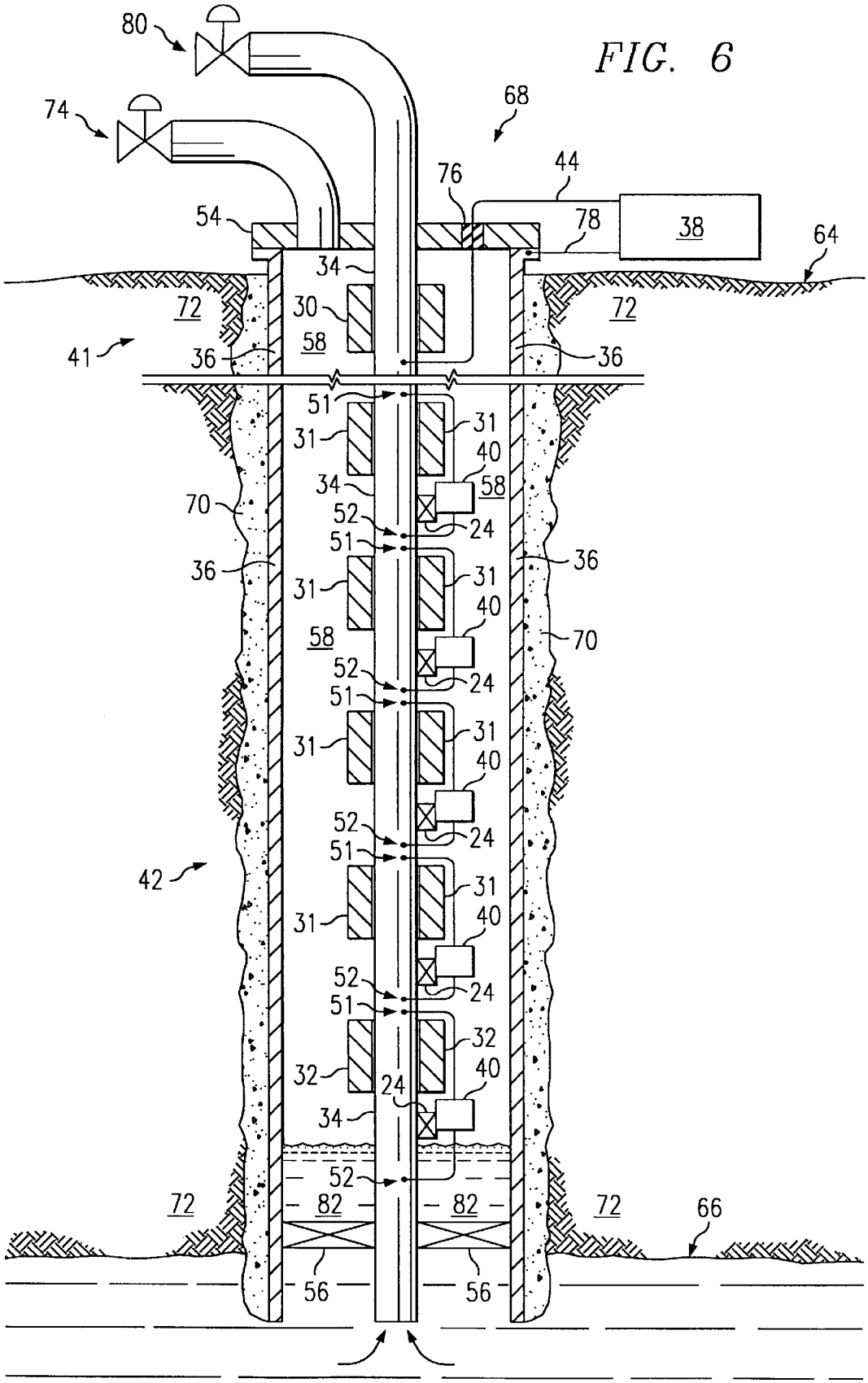
FIG. 6 is a schematic showing a possible application of the first embodiment of FIG. 1.

FIG. 6 shows a possible application of the system for defining an electrical circuit in accordance with the first embodiment of the present invention. A gas-lift oil well extends from the surface 64 through a borehole and extends into a production zone 66 downhole. A hanger 54 supports a production tubing string 34 from a well casing 36. The casing 36 is conventional, i.e., it is typically metal tubing held in place by injecting cement 70 between the casing and the earth in the borehole during well completion. Similarly the tubing string 34 is generally conventional comprising a plurality of elongated tubular metal production pipe sections joined by threaded couplings (not shown) at each location of the tubing sections. A gas input throttle 74 is employed to permit the input of compressed gas into the tubing 34 via valves 40 for lifting oil during production. Schematically illustrated is a computer system and power source 38 at the surface 64 with power and communication feeds 44 passing through pressure seal 76 in the hanger 54 and using return connections 78, which are electrically connected to the casing 36. Ferromagnetic induction chokes 30, 31, 32 are installed on the production tubing 34 to act as series impedances to AC flow and to define an electrical path along the tubing string 34 between the upper choke 30 and lowest choke 32. As previously explained with reference to FIG. 1, the electrical effect of the upper choke 30 is similar to that of the insulating tubing joint 146 illustrated in FIG. 1.

Referring to FIG. 6, in a typical manner, a packer 56 is placed downhole in the casing 36 above the production zone 66. The packer 56 hydraulically isolates the production zone, but electrically connects the production tubing 34 with the outer metal casing 36. Similarly, above the surface 64 the metal hanger 54 (along with the surface valves 80, platform 68, and other production equipment) electrically connects the production tubing 34 to the outer metal casing 36. Typically, such a configuration would not allow AC power or electrical signals to be passed up or down the well using the tubing 34 as one conductor and the casing 36 as the other conductor. However, the use of induction chokes 30, 31, 32 alters the electrical characteristics of the well's piping structure providing a system and method to pass AC power and communication signals up and down the borehole of the oil well via the tubing 34 and the casing 36, and to make this power available to downhole modules 40. An electrical potential is formed between the tubing 34 and the casing 36 between the upper choke 30 and the lowest choke 32, and on the tubing 34 at each choke 31. Hence, devices 40 can be powered by connecting a first device terminal 51 to the tubing 34 above the chokes 31, 32 and connecting a second device terminal 52 to the tubing below each choke 31,32.

Figure 7:
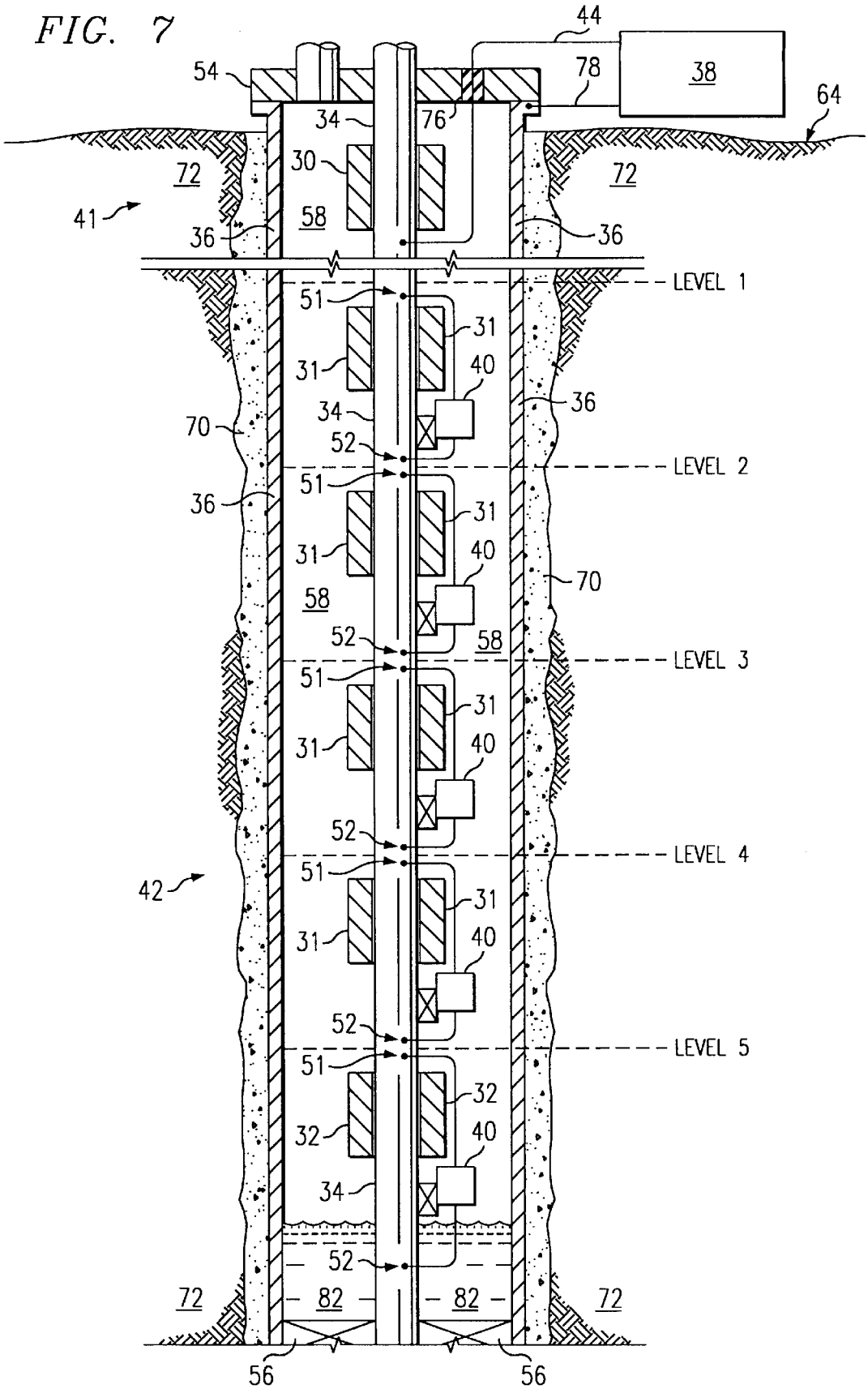
FIG. 7 is a schematic illustrating a method for unloading a gas lift well using the embodiment of FIG. 2.

FIG. 7 illustrates a method for applying the system of FIG. 6 to an unloading process for a gas lift well. Typically the unloading process starts with the annulus 58 filled with completion fluid 82, to level 1 of the well as illustrated in FIG. 7. The completion fluid 82 is normally a brine which is electrically conductive, and thus creates an electrical connection between tubing 34 and casing 36. Each downhole module 40 controls a motorized gas lift valve which may be opened to permit fluid, either liquid or gas, to pass from the annulus 58 to the interior of tubing 34. At the start of the unloading process all of these lift gas valves are open, but none of the modules 40 can be powered at this point in time since the completion fluid creates an electrical short circuit between the tubing 34 and the casing 36 at a point above all of the chokes 31.

To initiate the unloading process, lift gas under pressure from a surface supply is admitted to the annulus 58, and starts to displace the completion fluid through the open lift gas valves of each of the downhole modules 40, thus driving down the level of the completion fluid. When the level of the completion fluid has reached level 2 shown on FIG. 7, the first module 40 immediately above level 2 has become powered and thus controllable, since the tubing and casing above level 2 are no longer electrically short-circuited above level 2. The lift gas valve associated with the module immediately above level 2 may now be regulated to control the flow of lift gas into the tubing 34. The rising column of lift gas bubbles lightens the liquid column between this first valve and the surface, inducing upwards flow in the production tubing. At this point in the unloading process therefore, the uppermost lift gas valve is passing gas under control from commands sent from surface equipment 38, and the other lift gas valves are open to pass completion fluid but cannot yet be controlled.

Completion fluid continues to be expelled through the lower open valves until the completion fluid level reaches level 3. At this point the module 40 immediately above level 3 becomes powered and controllable as described with reference to the valve at level 2, so that lift gas flow through the valve at level 3 may now be regulated by commands sent from the surface. Once this flow is established, the lift gas valve at level 2 may be closed, and lift of fluids in the tubing 34 is thus transferred from level 2 to level 3.

In like manner, as the completion fluid continues to be expelled and its surface passes levels 4 and 5, the gas lift valves at these levels become powered and controllable at progressively greater depths. As gas lift progresses down the tubing, the valves above are closed to conserve lift gas, which is directed to only the lowermost open valve. At the end of the unloading process, only the gas lift valve at choke 32 is open, and all valves above it are closed.

This method for controlling the unloading process ensures that each valve is closed at the correct moment. In existing practice and without benefit of means to control directly the lift gas valves, the cycling of the intermediate valves between open and closed is implemented by using pre-set opening and closing pressures. These preset values are chosen using design calculations which are based on incomplete or uncertain data. The consequence is that in existing practice the valves frequently open and close at inappropriate times, causing lift instability, excessive wear or total destruction of the valves, and also inefficiencies in lift gas usage from the need to specify the valve presets with pressure margins which reduce the range of gas pressures which can be made available for lift during the unloading and production processes.

The method described for the unloading process provides a similar benefit for well kickoff. In this case the assumed starting condition is with the annulus pressurized by lift gas and therefore cleared of conductive fluid, but with lift gas flow stopped either because the well has been shut in, or is killed. The supply pressure of the lift gas source is normally insufficient to initiate lift gas flow immediately through the bottom valve, associated with choke 32 in FIG. 7, since with no lift gas flowing the tubing 34 is filled with a static column of produced liquids which exert a head pressure greater than the available lift gas pressure. To initiate lift, the intermediate valves at levels 2 though 5 of FIG. 7 must be cycled open progressively to lighten the fluid column in tubing 34, and then closed when gas injection has been achieved from a lower valve. The benefits of the powered and controllable valves for kickoff are the ability to cycle the valves in the correct sequence, to be sure that each is positively open or closed at the correct point in the kickoff process, to be able to use the available lift gas pressure to best advantage, and to use lift gas quantity in the most economical manner consistent with obtaining lift.

Referring to FIG. 3, it will be seen that the downhole modules are electrically in series with each other. When there are several downhole modules as in FIGS. 6 and 7, the voltages on the tubing generated by the chokes 30, 31, 32 combine additively to determine the voltage which must be applied at the well head by the surface equipment. There are alternative embodiments in which the downhole equipment is arranged in electrical parallel, which in certain applications may be desirable to reduce the voltage which must be applied at the wellhead.

Figure 8:
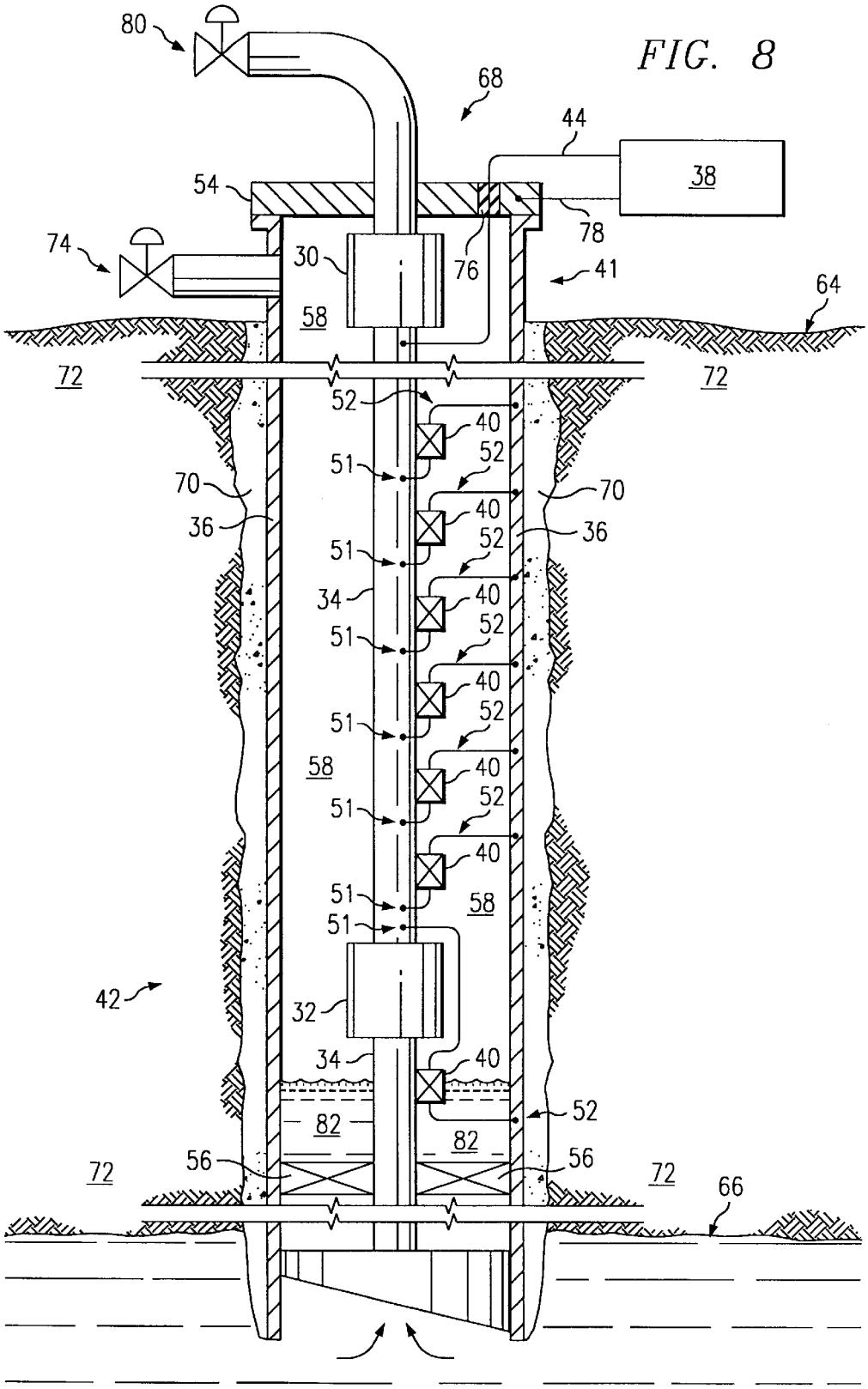
FIG. 8 is a schematic showing a disposition of chokes and downhole modules providing an electrical parallel configuration.

FIG. 8 illustrates schematically a well similar to that of FIG. 6, furnished with a plurality of downhole electrical control, measurement and communication modules 40. In this embodiment the power for each pod is derived from the voltage developed between the tubing 34 and the casing 36, by the chokes 30 and 32. In contrast to the serial connections of the embodiment of FIG. 7, in the embodiment of FIG. 8 the electrical connections to the downhole modules 40 are in parallel. In this embodiment therefore the voltage which must be applied at the wellhead by the surface equipment 38 through the conductor 44 remains the same regardless of the number of downhole modules, but the current which must be supplied is in proportion to the number of downhole modules. This embodiment would be inoperable so long as conductive fluid were present in the annulus above the lower choke 32, but it has the advantage that the wellhead electrical potential remains low and therefore safe regardless of the number of downhole modules.

Figure 9A:
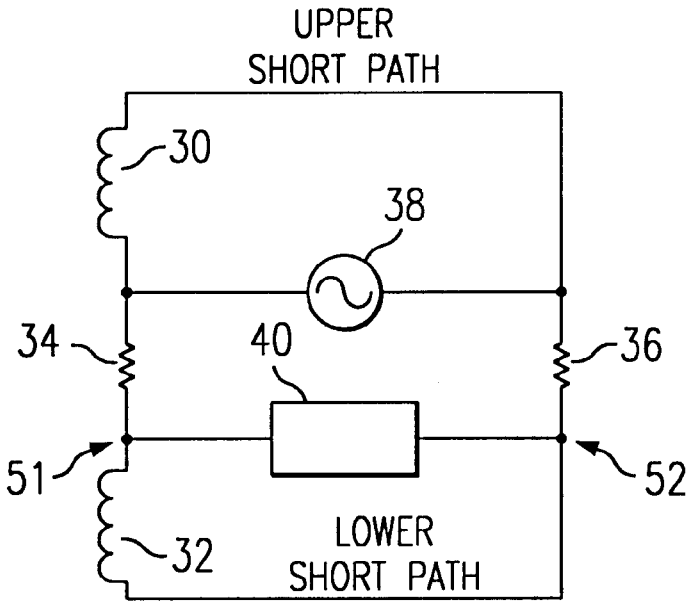
FIG. 9*a* is a simplified electrical equivalent circuit representation of the embodiment of FIG. 8.
Figure 9B:
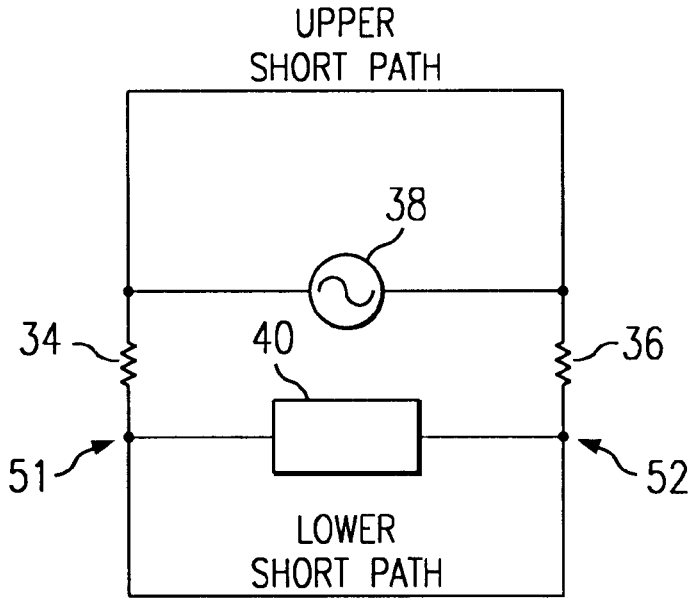
FIG. 9*b* is a simplified electrical equivalent circuit representation of the embodiment of FIG. 9*a* but without using inductive chokes, for comparison.

FIGS. 9*a* and 9*b* illustrate schematically the difference that the induction chokes 30, 32 make in the electrical circuit. FIG. 9A is a simplified schematic representing the electrical circuit of the embodiment shown in FIG. 8. Whereas, FIG. 9*b* is a simplified schematic of what the electrical circuit would be without the use of the induction chokes 30, 32 in accordance with the present invention. The preferred or natural path of AC in the circuit shown in FIG. 9B is to take the upper short path of least resistance rather than travel through the tubing 34, through the devices 40, and through the casing 36.

Looking back to FIG. 9A in comparison, instead of traveling across the upper short path that now has a large inductor (the upper induction choke 30 along a first location 41 of the tubing 34), most of the current will be forced to flow along the tubing 34. The impedance provided by the induction effect of the upper choke 30 creates a substantial barrier to passage (back-e.m.f.) of most of the AC current. Again looking at FIG. 9B, without the lower choke 32, there is a lower short path from the tubing 34 to casing 36, such as a packer 56 (see FIGS. 1 and 6) or a conductive fluid 82. With the lower choke 32 in place, instead of traveling across the lower short path that now has a large inductor (lower induction choke 32), most of the current will be forced to flow across the device 40 to reach the electrical return (e.g., casing 36). Thus, the goal of providing electrical power and/or communications to a device 40 downhole using the tubing 34 and casing 36 as electrical paths in the circuit is accomplished by using this embodiment of the present invention.

It will be clear to those skilled in the art that combinations of serial and parallel power and communication connections are possible by using combinations of the disposition of chokes described in reference to FIGS. 6 and 8. By using electrical switches within the downhole modules 40, controlled from the surface, the configuration of downhole power and communication signals may be dynamically configured to be either series or parallel for each individual downhole module.

FIGS. 6 and 8 may be used to illustrate another application of the present invention. Devices 40 contain communications modems used to relay a signal up or down the well. In another possible application, devices 40 may also contain various sensors to measure the characteristics of the well downhole conditions, including but not limited to: temperature, pressure, chemical composition, flow rate, pool depth, or any combination thereof. For example, if a downhole device 40 comprises a sensor, a valve, and a logic circuit, a closed loop system can operate downhole to optimize the oil flow by varying the gas input according to the sensor readings using logic rules. As another example, if a downhole device 40 comprises a sensor, a communications modem, and a controllable valve, another closed loop system can be formed. The device 40 can measure one or more characteristics of the well conditions using the sensor, and send the data obtained by the sensor uphole to a computer system using the modem. With the well condition data from the downhole sensor, the computer system at the surface can analyze the data (and possibly in combination with other data from other similar downhole sensors), and provide instructions for controlling the valve downhole. The control signals for the valve can be transmitted downhole to the modem in the device, which can be used to control the valve (e.g., change valve settings). Such controllable devices 40 downhole have the potential to greatly increase the production efficiency of a gas-lift oil well, as well as provide more controllable unloading and/or kick-off, which may translate into cost savings and increased earnings for the oil production company.

A system in accordance with the present invention is relatively robust and reliable due to its low number of additional parts needed (in addition to typical, existing equipment being used in the oil fields). Because the induction chokes 30, 32 are unpowered and have no moving parts, there are few failure modes. Also, a system in accordance with the present invention has the advantage that it can be adapted to use much of the existing petroleum well equipment designs (e.g., tubing 34, packers 56, casing 36).

Figure 10:
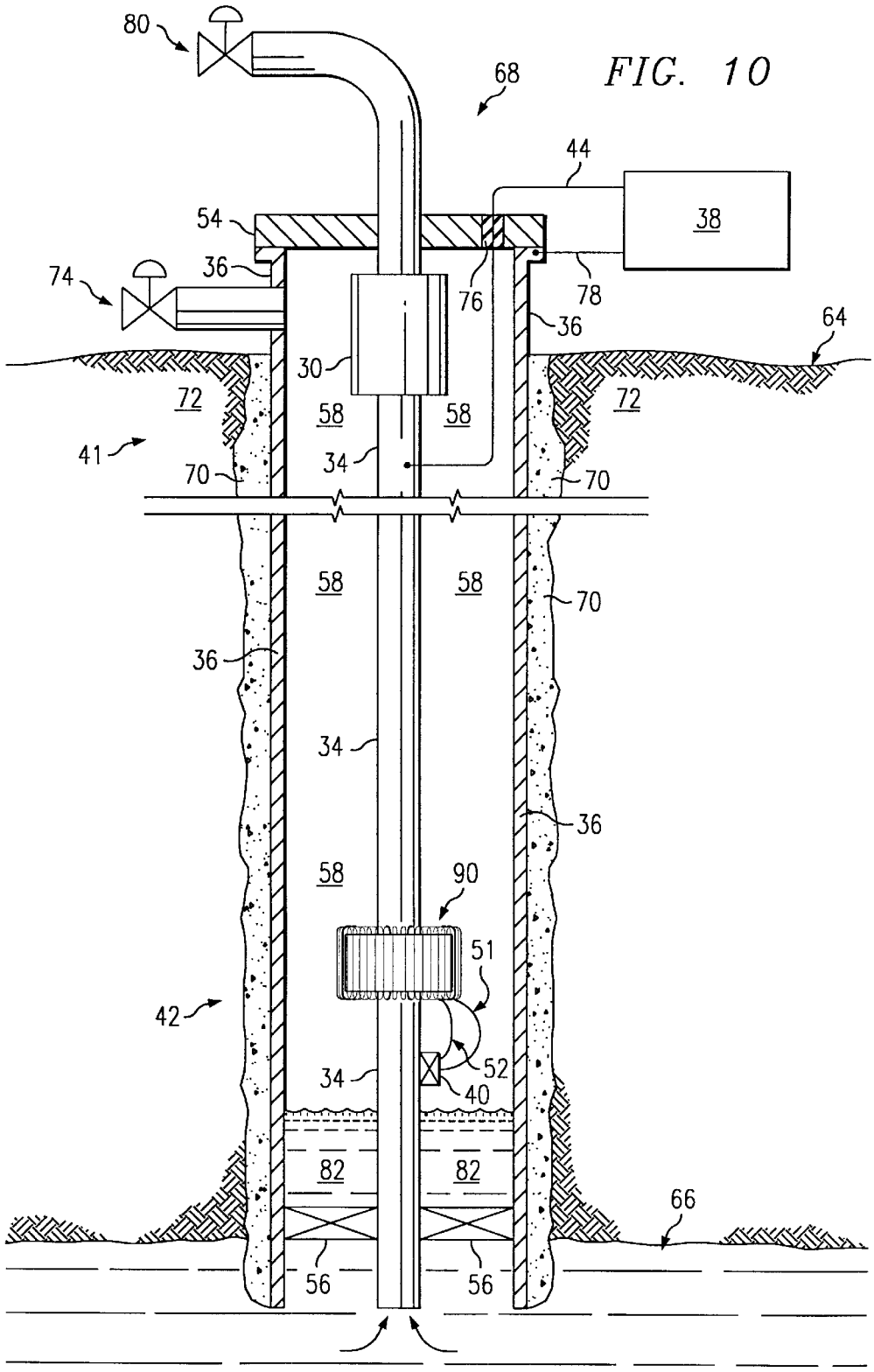
FIG. 10 is a schematic showing a system with an embodiment of the present invention using a current transformer.

FIG. 10 illustrates an alternative embodiment in accordance with the methods of the present invention. This embodiment uses only one choke 30 along a first location 41 of a piping structure. In the example shown in FIG. 10, the piping structure is a production tubing string 34, and the electrical return comprises a well casing 36. This embodiment is similar to the embodiment described in reference to FIG. 6 in that it works the same as that embodiment at the first location 41 of the piping structure. However, instead of having a choke 32 at the second location 42 (downhole) of the piping structure, a current transformer 90 is used to couple power and communications signals between device 40 and the tubing 34. Current flowing in tubing 34 links the current transformer 90, and passes to the lower part of the well where either packer 56 or conductive fluid 82 or both connect the tubing 34 to the casing 36, thus providing a return path for the power and communication signals to the surface equipment 38.

The embodiment of FIG. 10 is an alternative method for providing electrical power to devices 40 at depth within a well containing a conductive fluid 82 (e.g., saline solution) in the annulus 58 between the casing 36 and the production tubing 34. When the current transformer 90 is above the conductive fluid 82, AC current flow within the tubing 34 acts as the primary winding of the transformer and induces secondary current flow in the toroidal secondary winding of the current transformer 90. This secondary current can be used to provide electrical power and/or communications to the device 40 electrically connected to the transformer 90. Electrical isolation at the well head can take the form of choke 30 as illustrated in FIG. 10, or, as illustrated in FIG. 1, an electrically insulating tubing joint 146.

Figure 11:
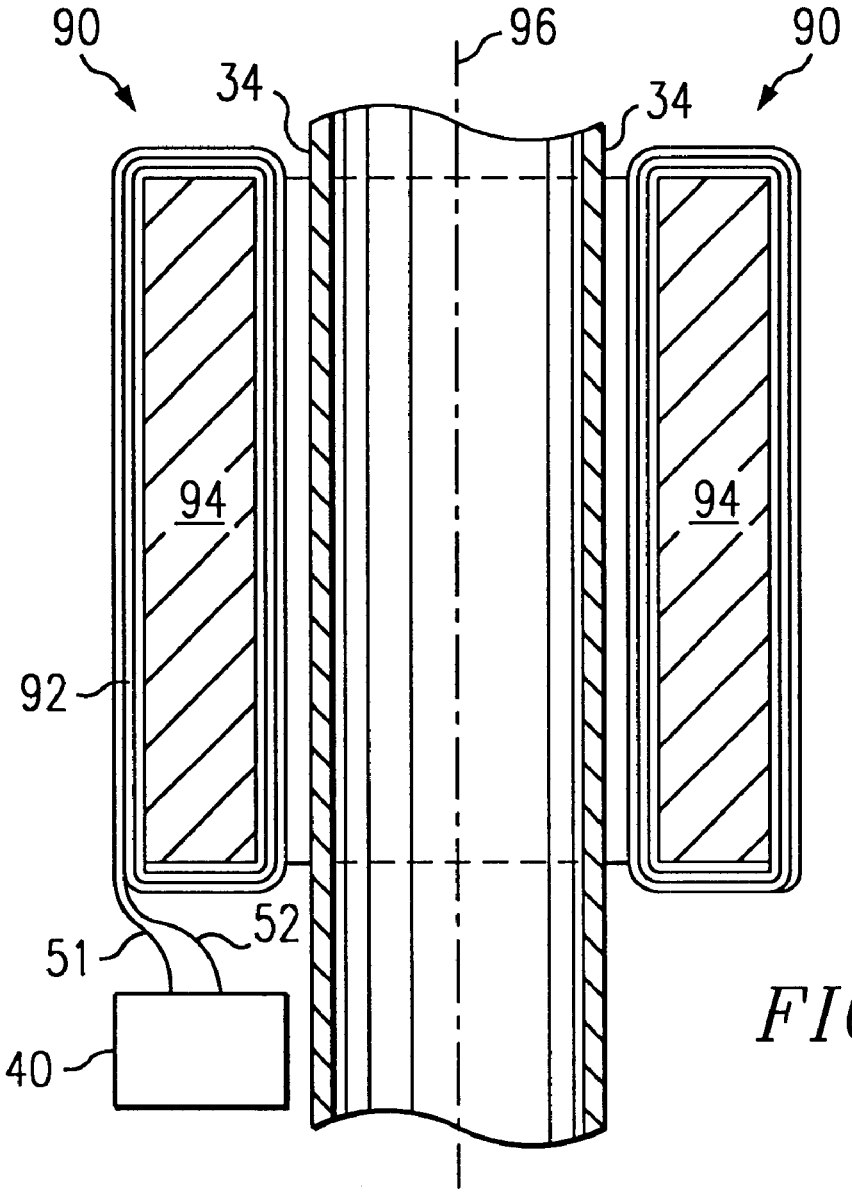
FIG. 11 is related to FIG. 10 and shows in more detail the current transformer of that embodiment.

FIG. 11 shows details of the current transformer 90 of FIG. 10. The transformer 90 comprises a cylindrical ferromagnetic core 94 wound such that the main lengths of the windings 92 are generally parallel to the axis of the core 96, following conventional practice for such a transformer. Effectively the tubing 34 acts as the primary winding of such a transformer 90, creating a circular magnetic field axially symmetric about the tubing axis, which is aligned with the transformer axis 96. This magnetic field induces an electrical current in the secondary winding 92, and this current is available to power and communicate with electrical or electronic equipment within the device 40 electrically connected to the current transformer secondary winding 92. The geometry, number of turns, length, and materials can vary for the transformer 90, depending on the application needs. Since the action of such a transformer is reversible, communication signals generated by a modem within module 40 may be coupled to tubing 34 for transmission to surface equipment. Thus, the goal of providing electrical power and/or communications to a device 40 downhole using the tubing 34 and casing 36 as electrical paths in the circuit is also accomplished by using this embodiment of the present invention.

The embodiment described in reference to FIGS. 10 and 11 is not limited to a single current transformer, but may be extended to multiple downhole transformers in a manner analogous to the multiple downhole chokes illustrated in reference to FIG. 6. Multiple such downhole power transformers provide a method to energize lift gas valves sequentially as annulus fluid level drops during the unloading or kickoff processes, as previously described in reference to FIG. 7, and with the same benefits.

Figure 12:
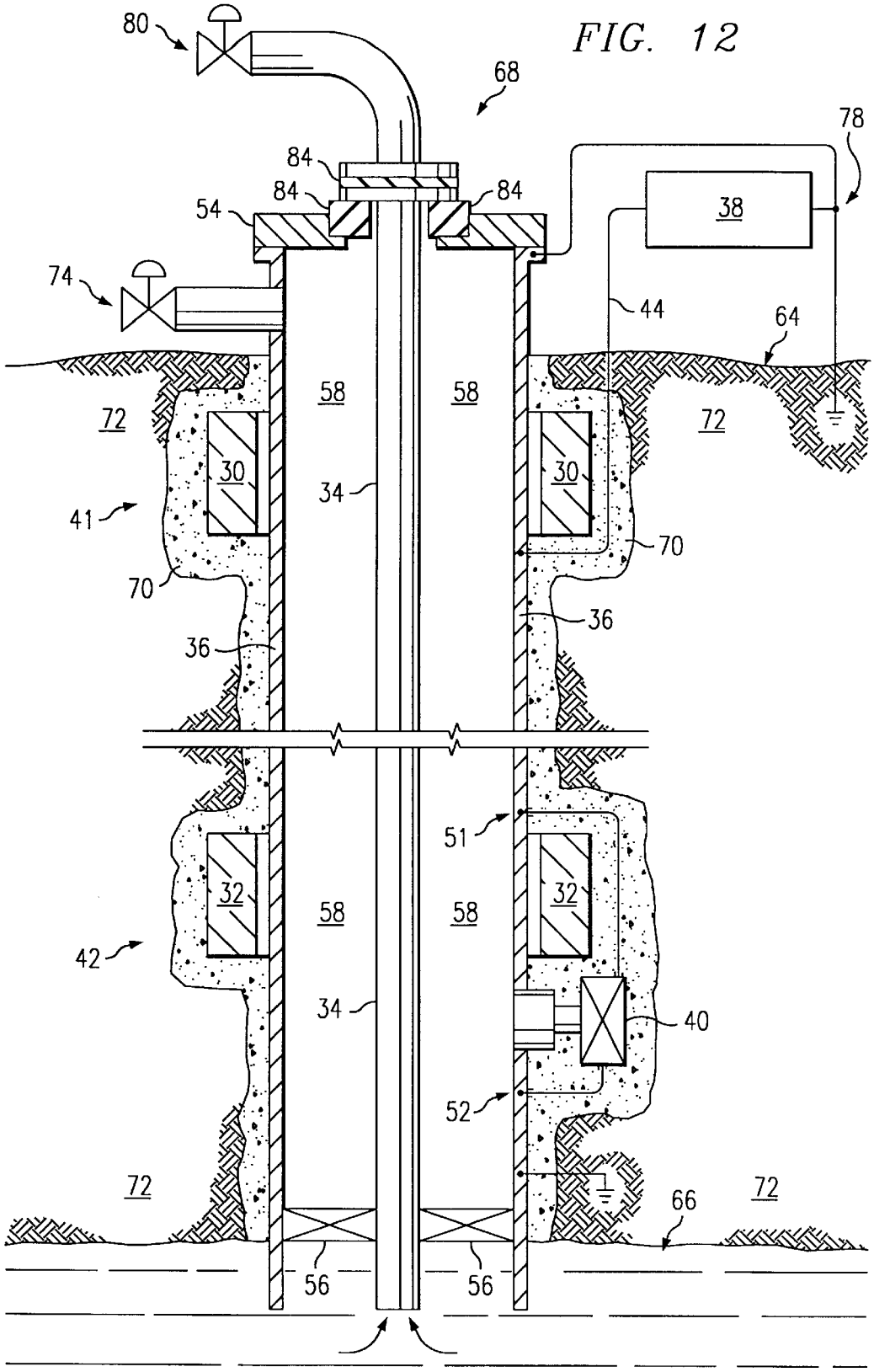
FIG. 12 is a schematic showing a system with an embodiment of the present invention using chokes external to the casing.

FIG. 12 shows a petroleum well application in accordance with another embodiment of the present invention, where the chokes are external to the casing. In this embodiment, the piping structure used to carry the electrical current for the downhole device 40 comprises the casing 36, which is a conductive metal tubing in this case, and the electrical return comprises the earthen ground 72. Thus, in this embodiment, the chokes 30, 32 are located about the casing 36 rather than being located only about the tubing 34 as in the embodiments described previously. In this embodiment, the current flows from the power source 38 to the casing 36 below the upper choke 30, along the casing 36 to a first device terminal 51 (due to the upper choke 30), through the device 40 (due to a voltage potential developed across the lower choke 32) to the earth ground 72 via the casing 36 below the lower choke 32, and back to the source 38 via the earthen ground 72 (and vice versa because AC).

In the choke design analysis previously described with reference to FIGS. 5*c–d,* current in both the casing 36 and the tubing 34 is impeded by a choke such as 30 or 32 of FIG. 9*a* since currents on both the casing and the tubing link the choke. The tubing cannot be used as the current return path for power applied to the casing since the magnetic fields from the supply and return currents would balance within the chokes, which would become ineffective. It is for this reason that that the ground return path 72 is necessary.

The potential developed on the casing across the choke 32 is connected by electrical conductors 51 and 52 to power and communicate with an instrument pod 40 located external to the casing. Chokes 30, 32, and the instrument pod 40, are set in the well with the casing and before the cement 70 is injected. As in the previous embodiments the instrument pod 40 may provide bidirectional communication through a modem to return data to the surface from sensors to measure conditions such as formation pressure, temperature, acoustic signals etc connected to pod 40, and to accept control commands from the surface.

Even though many of the examples discussed herein are applications of the present invention in petroleum wells, the present invention also can be applied to other types of well, including but not limited to: water wells and natural gas wells.

Also in a possible embodiment (not shown) of the present invention, the piping structures of two adjacent wells can be used to form a current loop for the electrical circuit. For example, a second location of a piping structure of a first well may be electrically connected (e.g., via a wire, conductive fluid, and/or the earth) to a second location of a piping structure of a second well adjacent to the first well, and a first location of the piping structure of the first well is electrically connected to a first terminal of a power source and a first location of the piping structure of the second well is electrically connected to a second terminal of the source, such that the electrical circuit is formed by using the piping structures of both wells. Hence, one of the piping structures will act as an electrical return. In another possible embodiment (not shown), two piping structures of the same well (e.g., two adjacent lateral branches) can be used to form a current loop for an electrical circuit. For example, the piping structure can be a first lateral branch and the electrical return can be a second lateral branch.

One skilled in the art will see that the present invention can be applied in many areas where there is a need to provide power and/or communication within a borehole, well, or any other area that is difficult to access. As discussed above, a production tubing string, as used in oil fields for withdrawing oil from a reservoir, is an example of a well with limited access downhole. Another example is the use of the present invention to provide power and/or communications to a device within a borehole of a machine part, where access within the borehole is limited. For example, when looking for cracks in a steam turbine using nondestructive testing techniques (e.g., ultrasonics, eddy current), there is often a need to provide power and communications to a sensor deep within a borehole of the steam turbine rotor that may be three to six inches in diameter and thirty feet long. The piping structure can comprise a rod or tube that physically supports the sensor, and the electrical return can comprise the machine part being inspected. Hence, the use of the present invention can provide a system and method of providing power and communications to a sensor deep within the borehole where access is limited.

Also, one skilled in the art will see that the present invention can be applied in many areas where there is an already existing conductive piping structure and a need to route power and/or communications in a same or similar path as the piping structure. A water sprinkler system or network in a building for extinguishing fires is an example of a piping structure that may be already existing and having a same or similar path as that desired for routing power and/or communications. In such case another piping structure or another portion of the same piping structure may be used as the electrical return. The steel structure of a building may be used as a piping structure and/or electrical return for transmitting power and/or communications in accordance with the present invention. The steel rebar in a concrete dam or a street may be used as a piping structure and/or electrical return for transmitting power and/or communications in accordance with the present invention. The transmission lines and network of piping between wells or across large stretches of land may be used as a piping structure and/or electrical return for transmitting power and/or communications in accordance with the present invention. Surface refinery production pipe networks may be used as a piping structure and/or electrical return for transmitting power and/or communications in accordance with the present invention. Thus, there are numerous applications of the present invention in many different areas or fields of use.

It will be appreciated by those skilled in the art having the benefit of this disclosure that this invention provides a system that uses at least one unpowered induction choke to form an electrical circuit in a piping structure. It will also be appreciated by those skilled in the art having the benefit of this disclosure that this invention provides a system for providing power and/or communications to a device downhole in a borehole of a well using an electrical circuit formed in a piping structure by using at least one unpowered induction choke. It will be further appreciated by those skilled in the art having the benefit of this disclosure that this invention provides a system and method of providing a downhole electrical circuit in a well or borehole formed by using at least one unpowered induction choke and at least one power transformer about an existing piping structure. It should be understood that the drawings and detailed description herein are to be regarded in an illustrative rather-than a restrictive manner, and are not intended to limit the invention to the particular forms and examples disclosed. On the contrary, the invention includes any further modifications, changes, rearrangements, substitutions, alternatives, design choices, and embodiments apparent to those of ordinary skill in the art, without departing from the spirit and scope of this invention, as defined by the following claims. Thus, it is intended that the following claims be interpreted to embrace all such further modifications, changes, rearrangements, substitutions, alternatives, design choices, and embodiments.

What is claimed is:

1. A current impedance apparatus for using a time-varying electrical signal in a piping structure, comprising:

an induction choke being generally configured for concentric positioning about a portion of said piping structure such that when said time-varying electrical signal is transmitted through and along said portion of said piping structure a voltage potential forms between said piping structure and an electrical return, and such that said voltage potential can be used by a device electrically connected to said piping structure.

2. A current impedance apparatus in accordance with claim 1, wherein said time-varying electrical signal is a power signal.

3. A current impedance apparatus in accordance with claim 1, wherein said time-varying electrical signal is a communications signal.

4. A current impedance apparatus in accordance with claim 3, wherein said induction choke comprises a ferromagnetic material.

5. A current impedance apparatus in accordance with claim 1, wherein said induction choke is generally cylindrical shaped with a generally cylindrical shaped borehole formed therethrough for receiving said piping structure.

6. A current impedance apparatus in accordance with claim 1, wherein said induction choke is unpowered, and said induction choke is adapted to function without being powered by an electrical connection due to its magnetic and geometric properties.

7. A current impedance apparatus in accordance with claim 1, further comprising an insulating shell that substantially covers the surfaces of said induction choke.

8. A current impedance apparatus with claim 1, wherein said choke has a relative permeability in the range of 1,000–150,000.

9. A method of powering a device electrically connected to an elongated conductor comprising the steps of:

positioning an induction choke in concentric relation about a portion of the conductor;

applying a time-varying electrical current to the conductor on one side of the induction choke;

developing a voltage potential between said conductor on one side and a ground return when said time-varying electrical current is applied to the conductor;

using the voltage potential to power a device coupled between said conductor on one side and the ground return.

10. The method of claim 9, wherein a current impedance device is coupled to the conductor, said one side of the conductor is interposed between said current impedance device and said induction choke.

11. A system for defining an electrical circuit, comprising:

a piping structure comprising a first location, a second location, and an electrically conductive portion extending between said first and second locations, wherein said first and second locations are distally spaced along said piping structure;

a source of time-varying current electrically connected to said electrically conductive portion of said piping structure at a location along said first location;

an induction choke located about part of said electrically conductive portion of said piping structure;

a device comprising two terminals, a first of said device terminals being electrically connected to said electrically conductive portion of said piping structure; and an electrical return electrically connecting between a second of said device terminals and said source to complete said electrical circuit.

12. A system in accordance with claim 11, wherein said choke is located along said second location, and said electrical connection location for said first device terminal is between said choke and said electrical connection location for said source.

13. A system in accordance with claim 12, wherein said piping structure is part of a petroleum well, said first location is near the surface, and said second location is downhole in a borehole of said well.

14. A system in accordance with claim 12, further comprising:

a current impedance apparatus located about a portion of said piping structure along said first location, such that said source is connected to said piping structure between said current impedance apparatus and said choke.

15. A system in accordance with claim 14, further comprising:

an electric power transformer located about a portion of said piping structure between said current impedance apparatus and said choke.

16. A system in accordance with claim 11, wherein said choke is located along said first location, said electrical connection location for said first device terminal is along said second location, and said electrical connection location for said source is between said choke and said electrical connection location for said first device terminal.

17. A system in accordance with claim 16, wherein said piping structure is part of a petroleum well, said first location is near the surface, and said second location is downhole in a borehole of said well.

18. A system in accordance with claim 16, further comprising:

an electric power transformer located about a portion of said piping structure, such that said electrical connection location for said source is between said choke and said transformer.

19. A system in accordance with claim 11, wherein said induction choke comprises a ferromagnetic material.

20. A system in accordance with claim 11, wherein said induction choke is not electrically powered, and said induction choke functions based on its magnetic material properties, its geometry, its size, and its placement relative to said piping structure.

21. A system in accordance with claim 11, wherein said induction choke is electrically insulated from said piping structure.

22. A system for providing power or communications to a remote device, comprising:

a piping structure comprising a first location, a second location, and an electrically conductive portion extending between said first and second locations, wherein said first and second locations are distally spaced along said piping structure;

an induction choke enveloping part of said piping structure;

a source of time-varying current electrically connected to said electrically conductive portion of said piping structure for supplying primary electrical current;

a transformer located proximate said piping structure and adapted to form a secondary coil for supplying secondary electrical current corresponding to said primary electrical current when said primary electrical current is flowing in said electrically conductive portion of said piping structure, wherein said electrically conductive portion of said piping structure acts as a primary coil;

an electrical return electrically connecting said electrically conductive portion of said piping structure and said source to complete an electrical circuit, such that said transformer is located between said connection of said source and said connection of said electrical return to said piping structure; and a device electrically connected to said transformer for receiving said secondary electrical current.

23. A petroleum well for producing petroleum products, comprising:

a piping structure comprising a first location, a second location, and an electrically conductive portion extending between said first and second locations, wherein said first and second locations are distally spaced along said piping structure;

an electrical circuit comprising said electrically conductive portion of said piping structure, a source of time-varying current, an induction choke, a device, and an electrical return;

said source of time-varying current being electrically connected to said electrically conductive portion of said piping structure proximate said first location;

said induction choke positioned proximate part of said electrically conductive portion of said piping structure;

said device comprising two terminals, a first of said device terminals being electrically connected to said electrically conductive portion of said piping structure; and said electrical return electrically connecting between a second of said device terminals and said source to complete said electrical circuit.

24. A petroleum well in accordance with claim 23, wherein said choke is located along said second location, and said electrical connection location for said first device terminal is between said choke and said electrical connection location for said source.

25. A petroleum well in accordance with claim 24, wherein said first location is near the surface and said second location is downhole in a borehole.

26. A petroleum well in accordance with claim 24, further comprising:

a second induction choke located about a portion of said piping structure along said first location, such that said source is connected to said piping structure between said chokes.

27. A petroleum well in accordance with claim 26, further comprising:

an electric power transformer located about a portion of said piping structure between said chokes.

28. A petroleum well in accordance with claim 24, further comprising:

an electric power transformer located about a portion of said piping structure between said electrical connection location for said source and said choke.

29. A petroleum well in accordance with claim 28, wherein said electric power transformer comprises a ferromagnetic toroid wound by wire such that said wire is generally parallel to a central axis of said toroid when wound about said toroid.

30. A petroleum well in accordance with claim 23, wherein said choke is located along said first location, said electrical connection location for said first device terminal is along said second location, and said electrical connection location for said source is between said choke and said electrical connection location for said first device terminal.

31. A petroleum well in accordance with claim 23, wherein said first location is near the surface and said second location is downhole in a borehole.

32. A petroleum well in accordance with claim 23, further comprising:

a second induction choke located about a portion of said piping structure along said second location, such that said electrical connection location for said source is between said chokes, and such that said electrical connection location for said first device terminal is between said second choke and said electrical connection location for said source.

33. A petroleum well in accordance with claim 23, further comprising:

an electric power transformer located about a portion of said piping structure, such that said electrical connection location for said source is between said choke and said transformer.

34. A petroleum well in accordance with claim 33, wherein said electric power transformer comprises a ferromagnetic toroid wound by wire such that said wire is generally parallel to a central axis of said toroid when wound about said toroid.

35. A petroleum well in accordance with claim 23, wherein said induction choke comprises a ferromagnetic material.

36. A petroleum well in accordance with claim 23, wherein said induction choke is not electrically powered, and said induction choke functions based on its magnetic material properties, its geometry, its size, and its placement relative to said piping structure.

37. A petroleum well in accordance with claim 23, wherein said induction choke comprises an insulating shell that substantially covers the surfaces of said induction choke.

38. A petroleum well in accordance with claim 23, wherein said induction choke is electrically insulated from said piping structure.

39. A petroleum well in accordance with claim 23, wherein the geometry, material properties, and size of said induction choke, and the frequency of a time-varying current output from said source are adapted to provide communications and power to said device using said electrical circuit.

40. A petroleum well in accordance with claim 23, wherein said choke has a relative permeability in the range of 1,000–150,000.

41. A petroleum well in accordance with claim 23, wherein said piping structure comprises at least a portion of a production tubing string for a well.

42. A petroleum well in accordance with claim 23, wherein said piping structure comprises at least a portion of a pumping rod for a well.

43. A petroleum well in accordance with claim 23, wherein said piping structure comprises at least a portion of a well casing for a well.

44. A petroleum well in accordance with claim 23, wherein said piping structure comprises at least a portion of at least one branch forming a lateral extension of a well.

45. A petroleum well in accordance with claim 23, wherein said piping structure comprises at least a portion of an oil refinery piping network.

46. A petroleum well in accordance with claim 23, wherein said piping structure comprises at least a portion of above surface refinery production pipes.

47. A petroleum well in accordance with claim 23, wherein said electrical return comprises at least a portion of a well casing for a well.

48. A petroleum well in accordance with claim 23, wherein said electrical return comprises at least a portion of an earthen ground.

49. A petroleum well in accordance with claim 23, wherein said electrical return comprises a conductive fluid.

50. A petroleum well in accordance with claim 23, wherein said electrical return comprises a packer.

51. A petroleum well in accordance with claim 23, wherein said electrical return comprises at least a portion of another piping structure of a same well.

52. A petroleum well in accordance with claim 23, wherein said electrical return comprises at least a portion of another piping structure of another well.

53. A petroleum well in accordance with claim 23, further comprising an electrical insulating barrier between said piping structure and at least a portion of said electrical return.

54. A petroleum well in accordance with claim 53, wherein said barrier comprises concrete.

55. A petroleum well in accordance with claim 23, wherein said device comprises an electrically controllable and electrically actuated valve.

56. A petroleum well in accordance with claim 23, wherein said device comprises a transformer.

57. A petroleum well in accordance with claim 23, wherein said device comprises a battery.

58. A petroleum well in accordance with claim 23, wherein said device comprises multiple components electrically connected together.

59. A petroleum well in accordance with claim 23, wherein said device comprises a sensor for data acquisition.

60. A petroleum well in accordance with claim 23, wherein said device comprises a sensor and an electrically controllable valve to form a close loop valve control system.

61. A petroleum well in accordance with claim 23, wherein said device comprises a tracer fluid and an electrically controllable release valve.

62. A petroleum well in accordance with claim 23, wherein said device comprises a modem.

63. A petroleum well in accordance with claim 23, further comprising:

an electrical insulator located at said first location of said piping structure, said insulator being between said piping structure and said electrical return such that said piping structure is electrically insulated from said electrical return along said first location.

64. A petroleum well in accordance with claim 63, wherein said insulator comprises an insulated hanger.

65. A petroleum well in accordance with claim 23, further comprising a computer system adapted to send and receive data to and from said device via said electric circuit.

66. A petroleum well for producing petroleum products, comprising:

a piping structure comprising a first location, a second location, and an electrically conductive portion extending between said first and second locations, wherein said first and second locations are distally spaced along said piping structure;

an electrical circuit comprising said electrically conductive portion of said piping structure, an induction choke, an electric power transformer, a source of time-varying current, and an electrical return;

said induction choke located about a portion of said piping structure;

said source of time-varying current electrically connected to said electrically conductive portion of said piping structure;

said electric power transformer located proximate said piping structure and adapted to form a secondary coil for supplying secondary electrical current corresponding to primary current supplied by said source of time-varying current via said piping structure;

said electrical return electrically connecting between said electrically conductive portion of said piping structure and said source to complete said electrical circuit, such that said transformer is located between said electrical connection location for said source and said electrical connection location for said electrical return along said piping structure; and a device being electrically connected to said transformer for receiving said secondary electrical current.

67. A petroleum well in accordance with claim 66, wherein said choke is located along said first location, and said electrical connection location for said source is located between said choke and said transformer.

68. A petroleum well in accordance with claim 67, wherein said transformer is located along said second location.

69. A petroleum well in accordance with claim 67, wherein said transformer is located along said first location.

70. A petroleum well in accordance with claim 67, further comprising a second induction choke located about a portion of said piping structure along said second location, such that said transformer is located between said chokes.

71. A petroleum well in accordance with claim 66, wherein said choke is located along said second location, and said electrical connection location for said source is located along said first location.

72. A petroleum well in accordance with claim 71, wherein said electrical connection location for said electrical return is located between said transformer and said choke.

73. A petroleum well in accordance with claim 71, further comprising:

an electrical insulator along said first location, such that said electrical connection location for said source is between said insulator and said transformer.

74. A petroleum well in accordance with claim 73, wherein said insulator comprises an insulated hanger.

75. A petroleum well in accordance with claim 66, wherein said electric power transformer comprises a ferromagnetic toroid wound by wire such that said wire is generally parallel to a central axis of said toroid when wound about said toroid.

76. A petroleum well in accordance with claim 66, wherein said induction choke comprises a ferromagnetic material.

77. A petroleum well in accordance with claim 66, wherein said induction choke is not electrically powered, and said induction choke functions based on its magnetic material properties, its geometry, its size, and its placement relative to said piping structure.

78. A petroleum well in accordance with claim 66, wherein said induction choke is electrically insulated from said piping structure.

79. A petroleum well in accordance with claim 66, wherein said piping structure comprises a production tubing string for a well.

80. A petroleum well in accordance with claim 66, wherein said piping structure comprises a pumping rod for a well.

81. A petroleum well in accordance with claim 66, wherein said piping structure comprises a well casing for a well.

82. A petroleum well in accordance with claim 66, wherein said piping structure comprises at least one branch forming a lateral extension or a horizontal extension of a well.

83. A petroleum well in accordance with claim 66, wherein said electrical return comprises a well casing for a well.

84. A petroleum well in accordance with claim 66, wherein said electrical return comprises an earthen ground.

85. A petroleum well in accordance with claim 66, wherein said electrical return comprises a conductive fluid.

86. A petroleum well in accordance with claim 66, wherein said electrical return comprises a packer.

87. A method of operating a well having a pipe disposed in the earth comprising the steps of:

providing an induction choke coupled to the pipe downhole and disposed in enveloping relationship to a portion of the pipe;

coupling time varying current to the pipe uphole relative to the choke;

inhibiting time varying current flow distal to the choke and developing a voltage potential between the choke and a ground return;

coupling a device to the pipe uphole relative to the choke; and operating said device with said voltage potential to operate said well.

88. The method of claim 87, including coupling a current impedance apparatus near the surface to define an electrically conductive portion of the pipe between the current impedance apparatus and the choke, wherein the time varying current is applied to the pipe in the electrically conductive portion.

89. The method of claim 88, said pipe comprising the production tubing in a petroleum well and grounding said devices to casing in the well.

90. The method of claim 87, including coupling a plurality of devices connected to the pipe uphole relative to the choke and powered by said time varying current.

91. In a petroleum well having a piping structure embedded in an elongated borehole extending into the earth, the improvement comprising:

an induction choke configured for enveloping a portion of said piping structure and operable for developing a voltage potential between the piping structure and a ground return when a time-varying current is applied to the piping structure on one side of the induction choke.

* * * * *